US012429268B2

(12) United States Patent
Chen et al.

(10) Patent No.: US 12,429,268 B2
(45) Date of Patent: Sep. 30, 2025

(54) ICE MAKER

(71) Applicant: GUANGZHOU ARGION ELECTRIC APPLIANCE CO., LTD., Guangdong (CN)

(72) Inventors: Li Chen, Guangdong (CN); Changhui Lu, Guangdong (CN)

(73) Assignee: GUANGZHOU ARGION ELECTRIC APPLIANCE CO., LTD., Guangzhou (CN)

( * ) Notice: Subject to any disclaimer, the term of this patent is extended or adjusted under 35 U.S.C. 154(b) by 177 days.

(21) Appl. No.: 18/200,566

(22) Filed: May 22, 2023

(65) Prior Publication Data

US 2023/0375244 A1 Nov. 23, 2023

(30) Foreign Application Priority Data

May 20, 2022 (CN) ..... 202210566597.0

(51) Int. Cl.
*F25C 1/18* (2006.01)
*F25C 1/25* (2018.01)
*F25C 5/10* (2006.01)

(52) U.S. Cl.
CPC ..... *F25C 1/18* (2013.01); *F25C 1/25* (2018.01); *F25C 5/10* (2013.01)

(58) Field of Classification Search
CPC ..... F25C 1/18; F25C 1/22; F25C 1/24; F25C 1/243; F25C 1/246; F25C 1/04;
(Continued)

(56) References Cited

U.S. PATENT DOCUMENTS

RE17,279 E * 4/1929 Copeman ..... F25C 1/24 206/591
2,775,101 A * 12/1956 Hanson ..... F25C 1/04 62/437

(Continued)

FOREIGN PATENT DOCUMENTS

CN 206300390 U 7/2017
CN 208998392 U * 6/2019 ..... F25C 2400/14
WO WO-2019088332 A1 * 5/2019 ..... A23G 9/44

OTHER PUBLICATIONS

WO-2019088332-A1 English Translation (Year: 2019).*
CN-208998392-U English Translation (Year: 2019).*

*Primary Examiner* — Frantz F Jules
*Assistant Examiner* — Devon Moore

(57) ABSTRACT

An ice maker includes a cabinet body, and a refrigeration box and a refrigeration assembly provided in the cabinet body. The refrigeration box is connected to a water inlet pipe, a support member is provided in the refrigeration box, a grid tray is arranged on the support member, and ice containers are sequentially arranged on the grid tray. Die cavities are provided in the ice containers, water inlet holes communicated with the die cavities are formed in bottoms of the ice containers, and water outlet holes communicated with the die cavities are formed in tops of the ice containers. The refrigeration assembly includes a fan, an evaporator, a compressor, and a condenser. The fan and the evaporator are disposed in the refrigeration box, and the compressor and the condenser are disposed outside the refrigeration box. A heating pipe wraps the refrigeration box.

11 Claims, 20 Drawing Sheets

(58) Field of Classification Search
CPC ..... F25C 1/25; F25C 1/12; F25C 1/08; F25C 1/125; F25C 2400/06; F25C 2700/12; F25C 5/10; F25C 5/08
See application file for complete search history.

(56) References Cited

U.S. PATENT DOCUMENTS

| | | | | |
|---|---|---|---|---|
| 6,357,720 | B1 * | 3/2002 | Shapiro | F25C 1/18 426/66 |
| 11,959,687 | B2 * | 4/2024 | Miller | F25C 1/25 |
| 2015/0107275 | A1 | 4/2015 | Papalia | |
| 2021/0088267 | A1 * | 3/2021 | Nell | F25C 1/246 |
| 2023/0332816 | A1 * | 10/2023 | Junge | F25D 17/065 |
| 2024/0280305 | A1 * | 8/2024 | Mattson, Jr. | F25C 1/12 |

* cited by examiner

ICE MAKER

CROSS REFERENCE TO RELATED APPLICATIONS

The present application claims the benefit of Chinese Patent Application No. 202210566597.0 filed on May 20, 2022, the contents of which are incorporated herein by reference in their entirety.

TECHNICAL FIELD

The present disclosure relates to the technical field of ice preparation, and in particular to, an ice maker.

BACKGROUND

An ice maker is a kind of refrigeration mechanical device that turns water into ice. It is widely used in supermarket food preservation, fishery refrigeration, medical application, chemical industry, food processing, catering and other industries.

Compared with common ice, transparent ice used in bars and restaurants are more popular because of its higher transparency and less melting. However, the existing common ice maker cannot produce transparent ice, because a common ice making process makes the ice easily mixed with air bubbles, resulting in unsatisfactory transparency of the ice. Therefore, the bars and the restaurants can only purchase bulky finished transparent ice to process them into transparent ice of various shapes.

In fact, due to the limitations of the existing ice making process, the finished transparent ice are bulky, and the bars and the restaurants need to cut them by themselves after purchase, which is troublesome. In addition, the existing transparent ice maker has a complex structure and high purchase cost, which is unaffordable for some bars and restaurants. Therefore, how to achieve small-volume mass production of the transparent ice is an urgent problem to be solved at present.

SUMMARY

To solve the above technical problems, an objective of the present disclosure is to provide an ice maker, having advantages such as reliable structure and excellent ice making effect.

On this basis, the present disclosure provides an ice maker, including:

a cabinet body connected to a cabinet door configured to open or close the cabinet body;

a refrigeration box provided in the cabinet body, where a bottom surface or a side surface of the refrigeration box is connected to a water inlet pipe, a support member is provided on an inner side surface of the refrigeration box, a grid tray is arranged on the support member, and a plurality of ice containers are provided on the grid tray, die cavities are provided in the ice containers, water inlet holes communicated with the die cavities are formed in bottoms of the ice containers, and water outlet holes communicated with the die cavities are formed in tops of the ice containers;

a refrigeration assembly including a fan, an evaporator, a compressor, and a condenser, where the fan and the evaporator are disposed in the refrigeration box and located above the ice containers, and the compressor and the condenser are disposed outside the refrigeration box and connected to the evaporator;

a heating pipe provided in the cabinet body and wrapping the refrigeration box; and a thermal insulation layer provided in the cabinet body and the cabinet door and wrapping the refrigeration box and the heating pipe.

In some embodiments of the present disclosure, the refrigeration assembly is configured to cool water in the die cavities and the refrigeration box in a single direction.

In some embodiments of the present disclosure, the ice maker further includes a pump, the pump is connected to the refrigeration box through the water inlet pipe, and the pump is configured to drive the water in the refrigeration box to flow.

In some embodiments of the present disclosure, the ice container is formed by combining a plurality of assembly members.

In some embodiments of the present disclosure, the ice container is formed by combining two assembly members, the two assembly members are respectively a first assembly member and a second assembly member, a first water inlet assembly groove and a first water outlet assembly groove are formed in a side surface of the first assembly member opposite to the second assembly member, a second water inlet assembly groove and a second water outlet assembly groove are formed in a side surface of the second assembly member opposite to the first assembly member, a first special-shaped groove is formed in the first assembly member, a second special-shaped groove is formed in the second assembly member, the first special-shaped groove and the second special-shaped groove are butted with each other to form the die cavity, the first water inlet assembly groove and the second water inlet assembly groove are butted with each other to form the water inlet hole, and the first water outlet assembly groove and the second water outlet assembly groove are butted with each other to form the water outlet hole.

In some embodiments of the present disclosure, the first assembly member and the second assembly member are clamped and connected, an assembly protrusion is provided on a side surface of the first assembly member facing the second assembly member, and an assembly groove matching the assembly protrusion is formed in the second assembly member.

In some embodiments of the present disclosure, grabbing portions are provided at a top of the first assembly member and a top of the second assembly member.

In some embodiments of the present disclosure, a water outlet groove is formed in a surface of the ice container, and the water outlet groove is connected to each water outlet hole and extends to an edge of the ice container.

In some embodiments of the present disclosure, a temperature sensor is provided in the refrigeration box.

In some embodiments of the present disclosure, the ice container is made of an elastic soft material.

In some embodiments of the present disclosure, a water overflow hole is formed in a side surface of the refrigeration box, and is connected to the water inlet pipe through a water outlet pipe.

In some embodiments of the present disclosure, the support member includes a plurality of hooks sequentially arranged along a vertical direction.

In some embodiments of the present disclosure, the grid tray is rectangular, a first fixed rod and a second sliding rod are provided on one pair of opposite side edges of the grid tray, a second fixed rod and a first sliding rod are provided on the other pair of opposite side edges of the grid tray, the first sliding rod is capable of sliding toward the first fixed rod, and the second sliding rod is capable of sliding toward the second fixed rod.

The embodiments of the present disclosure provide an ice maker. Compared with the prior art, the ice maker has the following beneficial effects:

The embodiments of the present disclosure provide an ice maker. The ice maker includes a cabinet body, and a refrigeration box and a refrigeration assembly provided in the cabinet body. A water inlet pipe is connected to a bottom surface or a side surface of the refrigeration box, a support member is provided on an inner side surface of the refrigeration box, a grid tray is arranged on the support member, and a plurality of ice containers are sequentially arranged on the grid tray. For the ice containers, die cavities are provided in the ice containers, water inlet holes communicated with the die cavities are formed in bottoms of the ice containers, and water outlet holes communicated with the die cavities are formed in tops of the ice containers. The refrigeration assembly includes a fan, an evaporator, a compressor, and a condenser, where the fan and the evaporator are disposed in the refrigeration box and located above the ice containers, and the compressor and the condenser are disposed outside the refrigeration box and connected to the evaporator. In addition, a heating pipe wraps the refrigeration box. Based on the above structure, an operator places the ice containers on the grid tray before use, and then puts the grid tray loaded with the ice containers into the refrigeration box. The above operation steps are not sequentially performed, and the grid tray can also be put into the refrigeration box first and then the ice containers are followed to arrange. After the ice containers are placed, a valve on the water inlet pipe is turned on to replenish water into the refrigeration box. The water level in the refrigeration box rises with time and enters the die cavities of the ice containers through the water inlet holes of the ice containers when the water level reaches the bottoms of the ice containers. After the die cavities are filled with the water, the excess water flows out from the water outlet holes of the ice containers and flows back into the refrigeration box. When the die cavities are full of water, the valve is turned off to keep the water level in the refrigeration box from changing. At this time, the refrigeration assembly is turned on, and the compressor transmits a low-temperature liquid refrigerant to the evaporator, and the low-temperature liquid refrigerant exchanges heat with air in the refrigeration box for vaporization and heat absorption, thereby reducing the temperature in the entire refrigeration box. The fan continuously transfers a low-temperature gas from the top to the bottom of the refrigeration box, and the water in the die cavities also freezes due to cold air. The cold air performs heat transfer from top to bottom under the action of the fan, and the water in the die cavities can only slowly solidify from top to bottom under the action of the cold air above. The upper water in the die cavities is crystallized and solidified first, and gas cannot be dissolved in the solid water. Therefore, the gas that should have been dissolved in the liquid water is squeezed into liquid water below, and also moves to the bottoms of the die cavities along with the solidification of the water in the die cavities, and finally discharges from the water inlet holes at the bottoms of the ice containers into the refrigeration box or dissolves in the water body in the refrigeration box. It should be noted that the thermal insulation layer wraps the refrigeration box, and the edges around the refrigeration box will not freeze first due to the cold air, thereby better ensuring that water in a cavity of the refrigeration box and the die cavity gradually cools off from top to bottom, and thus realizing the unidirectional cooling process. Meanwhile, the cavity of the entire refrigeration box forms a water storage structure to ensure that the refrigeration box has a sufficient water depth. This design has two advantages. The first is that the air bubbles in the ice containers can be directly dissolved in the water body in the refrigeration box after being discharged, which is convenient for the air bubbles in the ice containers to be discharged in time. The second is that the water depth in the refrigeration box is large such that the water body in the refrigeration box will not freeze completely. According to the specific ice making process, it can be found that the water body in the ice containers freezes from top to bottom to form ice, and all the water body in the ice containers freezes to form the ice and then continues to extend downwards and extend to the water body of the refrigeration box through the water inlet holes. That is, during the ice making process, part of the water in the refrigeration box will also freeze to form the ice connected to the ice in the ice containers, so when the ice containers are disassembled, it is necessary to fuse the ice between the water body of the ice containers and the water body of the refrigeration box to ensure normal removal of the ice containers. Returning to the above design, due to the large water depth in the refrigeration box, only part of the water body in the refrigeration box freezes, and the ice that need to be fused when heating the refrigeration box are greatly reduced, the melting time of the ice is short, and the ice containers can be easily removed from the grid tray. The above design makes the ice condensing mode of the present disclosure completely different from the mode of the traditional structure in which cold air is applied to condense ice from all directions at the same time, and it is easier to form transparent ice with high transparency and not easy to melt. Therefore, the formation of the ice in the die cavities is less affected by the air bubbles, the ice have high transparency and are not easy to melt, and the quality of the ice is very close to that of the transparent ice made by other special ice makers. The ice are made by independent ice containers, and there will be no influence between the ice containers. The sizes and shapes of the finished ice are consistent with those of the die cavities in the ice containers, no further cutting is required, and the operator can reasonably set the sizes and quantity of the ice containers according to the needs of use. After the ice making is completed, the heating pipe is started to heat the water body in the refrigeration box, and the water body in the refrigeration box will act on the water inlet holes of the ice containers after being heated, which can quickly realize the melting of the ice inside and outside the ice containers, avoid the icing adhesion between the ice containers and the refrigeration box, and realize rapid separation of the ice in the die cavities and the ice outside the die cavities. In this way, the ice maker optimizes the production process of the transparent ice, avoids segmentation in the later stage, can control the shapes of the transparent ice, and achieves excellent production effect.

Figure 1:
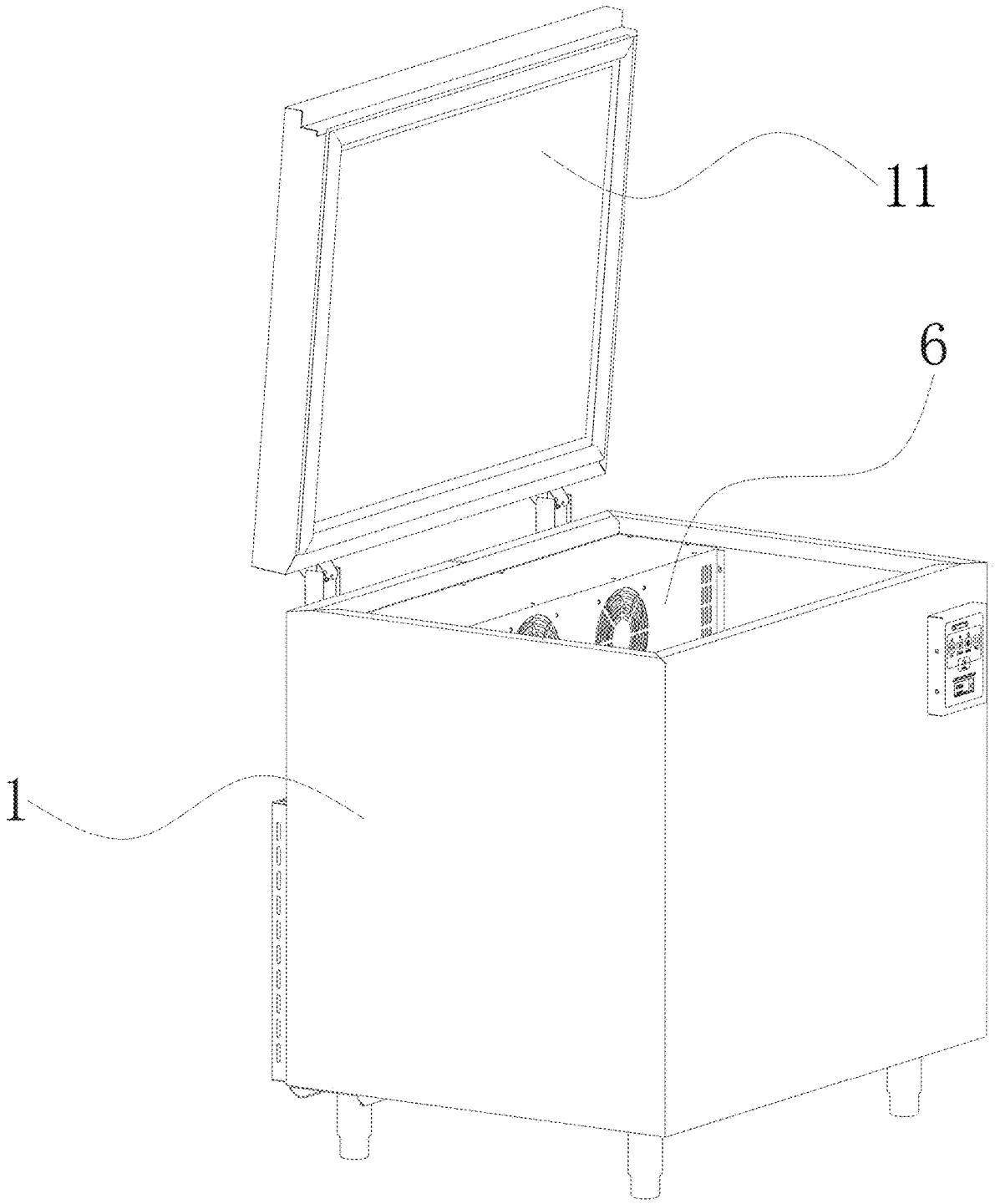
FIG. 1 is a schematic diagram of a front structure of an ice maker according to an embodiment of the present disclosure.
Figure 2:
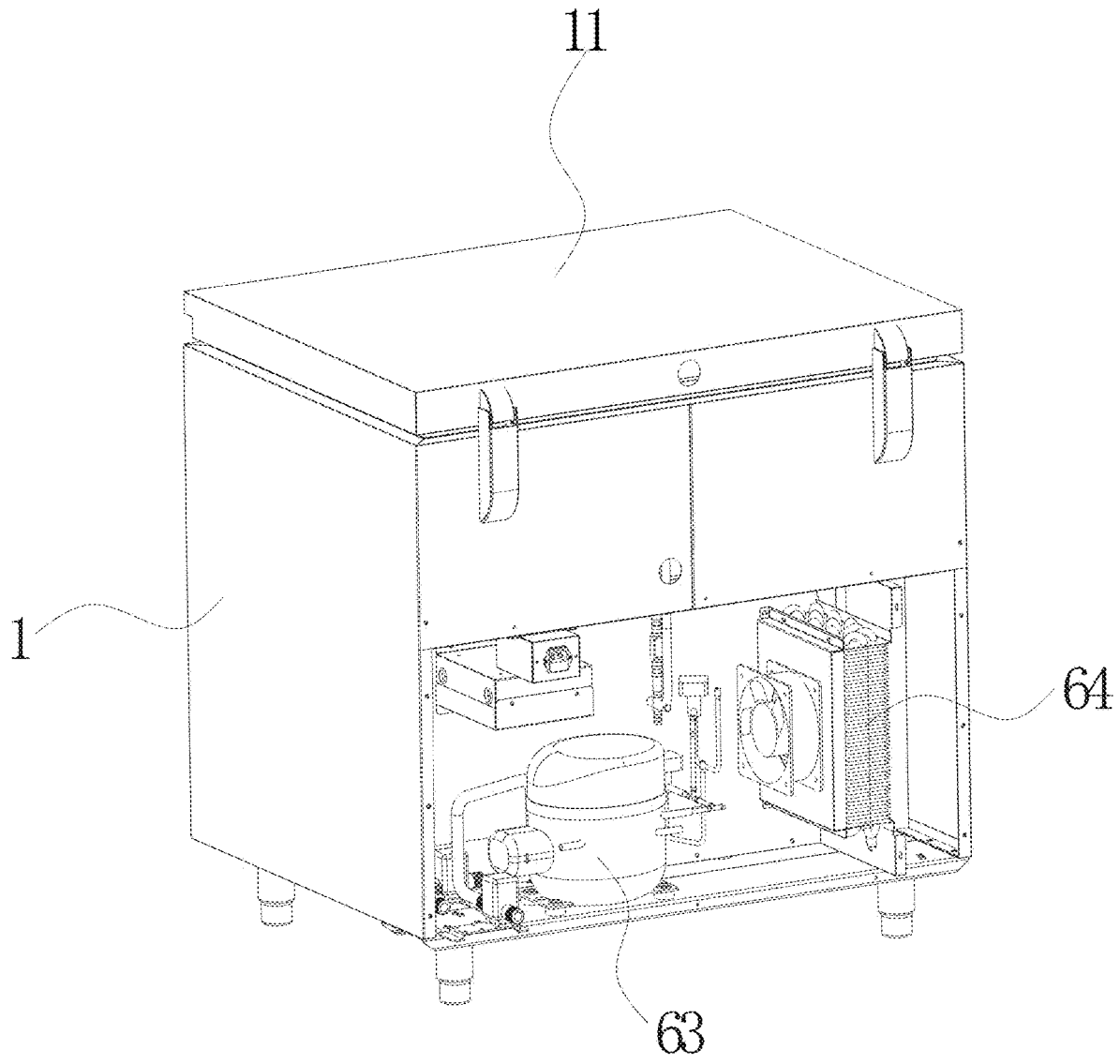
FIG. 2 is a schematic diagram of a back structure of an ice maker according to an embodiment of the present disclosure.
Figure 3:
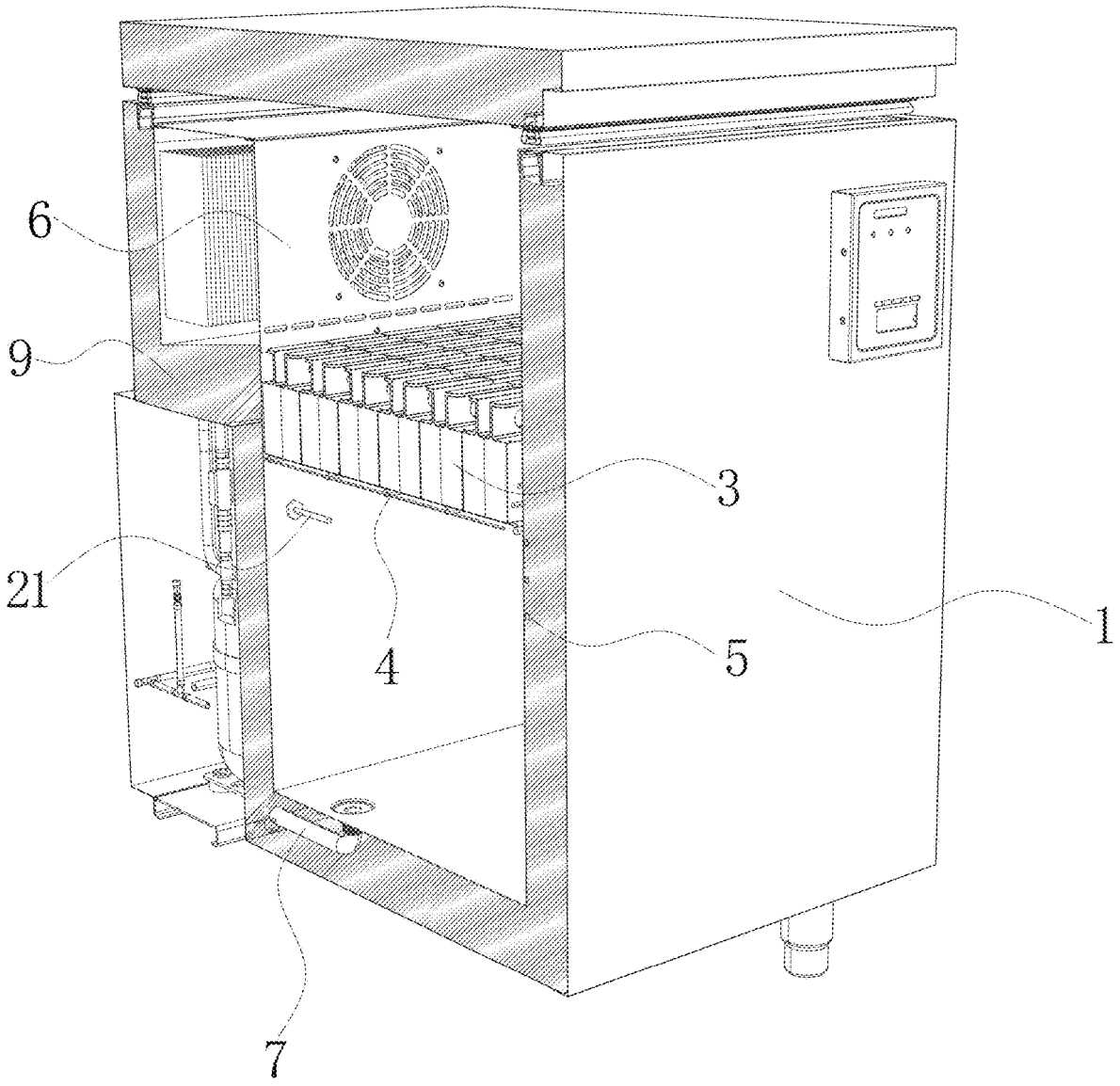
FIG. 3 is a side sectional view of an internal structure of an ice maker according to an embodiment of the present disclosure.

In the figures, 1. Cabinet body; 11. Cabinet door; 2. Refrigeration box; 21. Temperature sensor; 22. Support member; 221. Hook; 222. Mounting portion; 23. Water overflow hole; 3. ice container; 31. Die cavity; 32. Water inlet hole; 33. Water outlet hole; 34. Water outlet groove; 35. Grabbing portion; 36. Hollow hole; 301. Assembly member; 301*a*. First assembly member; 301*b*. Second assembly member; 3021. First water outlet assembly groove; 3022. Second water outlet assembly groove; 3023. First water inlet assembly groove; 3024. Second water inlet assembly groove; 3031. First special-shaped groove; 3032. Second special-shaped groove; 304. Assembly protrusion; 305. Assembly groove; 4. Grid tray; 41. First fixed rod; 42. First sliding rod; 43. Second fixed rod; 44. Second sliding rod; 45. Sleeve; 46. Pressing bolt; 5. Heating pipe; 6. Refrigeration assembly; 61. Fan; 62. Evaporator; 63. Compressor; 64. Condenser; 7. Water inlet pipe; 8. Storage box; 81. Water passing hole; 82. Storage plate; 821. Transverse plate; 822. Longitudinal plate; 83. Storage tank; 84. Handle; 9. Thermal insulation layer; and 10. Pump.

DETAILED DESCRIPTION

The specific implementations of the present disclosure are described in more detail below with reference to the accompanying drawings and embodiments. The following embodiments are illustrative of the present disclosure and should not be construed as limiting of the scope of the present disclosure.

It should be understood that the terms such as "front", "back", and the like are used in the present invention to describe various information, but the information should not be limited to these terms, and these terms are only used to distinguish the same type of information from each other. For example, without departing from the scope of the present disclosure, "front" information may be referred to as "back" information, and "back" information may also be referred to as "front" information.

As shown in FIG. 1 to FIG. 20, the embodiments of the present disclosure provide an ice maker. The ice maker includes a cabinet body 1, and a refrigeration box 2 and a refrigeration assembly 6 provided in the cabinet body 1. Specifically, a cabinet door 11 is provided at a top of the cabinet body 1, and is hinged to the cabinet body 1 to close the cabinet body 1. The refrigeration box 2 is disposed in the cabinet body 1. A water inlet pipe 7 is connected to a bottom surface or a side surface of the refrigeration box 2. In the embodiments of the present disclosure, the water inlet pipe 7 is connected to the bottom surface of the refrigeration box 2. A support member 22 is provided on an inner side surface of the refrigeration box 2, a grid tray 4 is arranged on the support member 22, and a plurality of ice containers 3 are sequentially arranged on the grid tray 4. For the ice containers 3, die cavities 31 are provided in the ice containers 3, water inlet holes 32 communicated with the die cavities 31 are formed in bottoms of the ice containers 3, and water outlet holes 33 communicated with the die cavities 31 are formed in tops of the ice containers 3. The refrigeration assembly 6 includes a fan 61, an evaporator 62, a compressor 63, and a condenser 64, where the fan 61 and the evaporator 62 are disposed in the refrigeration box 2 and located above the ice containers 3, and the compressor 63 and the condenser 64 are disposed outside the refrigeration box 2 and connected to the evaporator 62. In addition, a heating pipe 5 wraps the refrigeration box 2. A thermal insulation layer 9 is provided in the cabinet body 1 and a cabinet door 11, and wraps the refrigeration box 2 and the heating pipe 5.

Based on the above structure, an operator places the ice containers 3 on the grid tray 4 before use, and then puts the grid tray 4 loaded with the ice containers 3 into the refrigeration box 2. Of course, the above operation steps are not sequentially performed, and the grid tray 4 can also be put into the refrigeration box 2 first and then the ice containers 3 are followed to arrange. After the ice containers 3 are placed, a valve on the water inlet pipe 7 is turned on to replenish water into the refrigeration box 2. The water level in the refrigeration box 2 rises with time and enters the die cavities 31 of the ice containers 3 through the water inlet holes 32 of the ice containers 3 when the water level reaches the bottoms of the ice containers 3. After the die cavities 31 are filled with the water, the excess water flows out from the water outlet holes 33 of the ice containers 3 and flows back into the refrigeration box 2. When the die cavities 31 are full of water, the valve is turned off to keep the water level in the refrigeration box 2 from changing. At this time, the refrigeration assembly 6 is turned on, and the compressor 63 transmits a low-temperature liquid refrigerant to the evaporator 62, and the low-temperature liquid refrigerant exchanges heat with air in the refrigeration box 2 for vaporization and heat absorption, thereby reducing the temperature in the entire refrigeration box 2. The continuous operation of the fan 61 transfers a low-temperature gas from the top to the bottom of the refrigeration box 2, and the water in the die cavities 31 also freezes due to cold air. The cold air performs heat transfer from top to bottom under the action of the fan 61, and the water in the die cavities 31 can only slowly solidify from top to bottom under the action of the cold air above. The upper water in the die cavities 31 crystallizes and solidifies first, and gas cannot dissolve in the solid water. Therefore, the gas that should have been dissolved in the liquid water is squeezed to lower liquid water, and also moves to the bottoms of the die cavities 31 along with the solidification of the water in the die cavities 31, and finally discharges from the water inlet holes 32 at the bottoms of the ice containers 3 into the refrigeration box 2 or dissolves in the water body in the refrigeration box 2. It should be noted that since the thermal insulation layer 9 wraps the refrigeration box 2, and the edges around the refrigeration box 2 will not freeze first due to the cold air, thereby better ensuring that water in a cavity of the refrigeration box 2 and the die cavity 31 gradually cools off from top to bottom, and thus realizing the unidirectional cooling process. Meanwhile, the cavity of the entire refrigeration box 2 forms a water storage structure to ensure that the refrigeration box 2 has a sufficient water depth. This design has two advantages. The first is that the air bubbles in the ice containers 3 can be directly dissolved in the water body in the refrigeration box 2 after being discharged, which is convenient for the air bubbles in the ice containers 3 to be discharged in time. The second is that the water depth in the refrigeration box 2 is large such that the water body in the refrigeration box 2 will not freeze completely. According to the specific ice making process, it can be found that the water body in the ice containers 3 freezes from top to bottom to form ice, and all the water body in the ice containers 3 freezes to form the ice and then continues to extend downwards and extend to the water body of the refrigeration box 2 through the water inlet holes 32. That is, during the ice making process, part of the water in the refrigeration box 2 will also freeze to form the ice connected to the ice in the ice containers 3, so when the ice containers 3 are disassembled, it is necessary to fuse the ice between the water body of the ice containers 3 and the water body of the refrigeration box 2 to ensure normal removal of the ice containers 3. Returning to the above design, due to the large water depth in the refrigeration box 2, only part of the water body in the refrigeration box 2 freezes, and the ice that need to be fused when heating the refrigeration box 2 are greatly reduced, the melting time of the ice is short, and the ice containers 3 can be easily removed from the grid tray 4. The above design makes the ice condensing mode of the present disclosure completely different from the mode of the traditional structure in which cold air is applied to condense ice from all directions at the same time, and it is easier to form transparent ice with high transparency and not easy to melt. Therefore, the formation of the ice in the die cavities 31 is less affected by the air bubbles, the ice have high transparency and are not easy to melt, and the quality of the ice is very close to that of the transparent ice made by other special ice makers. The ice are made by independent ice containers 3, and there will be no influence between the ice containers 3. The sizes and shapes of the finished ice are consistent with those of the die cavities 31 in the ice containers 3, no further cutting is required, and the operator can reasonably set the sizes and quantity of the ice containers 3 according to the needs of use. After the ice making is completed, the heating pipe 5 is started to heat the water body in the refrigeration box 2, and the water body in the refrigeration box 2 will act on the water inlet holes 32 of the ice containers 3 after being heated, which can quickly realize the melting of the ice inside and outside the ice containers 3, avoid the icing adhesion between the ice containers 3 and the refrigeration box 2, and realize rapid separation of the ice in the die cavities 31 and the ice outside the die cavities 31. In this way, the ice maker optimizes the production process of the transparent ice, avoids segmentation in the later stage, can control the shapes of the transparent ice, and achieves excellent production effect.

Optionally, the refrigeration assembly is configured to cool water in the die cavities 31 and the refrigeration box 2 in a single direction. In an specific implementation, the single direction can be from top to bottom, from bottom to top, or from one side to the other side. For example, the single direction in this embodiment is from top to bottom. The water in the die cavity 31 and the refrigeration box 2 achieves a unidirectional cooling process, and the phase change process of water from liquid to solid also exhibits a single directionality. As a result, the gas that should have been dissolved in the upper water is continuously squeezed into the liquid water below, thereby achieving the transparency of the solid ice in the die cavity 31 due to the absence of gas. Of course, the refrigeration assembly can also be equipped with other cooling devices according to actual usage requirements to select the desired single direction for cooling the water in the die cavity 31 and the refrigeration box 2.

Figure 20:
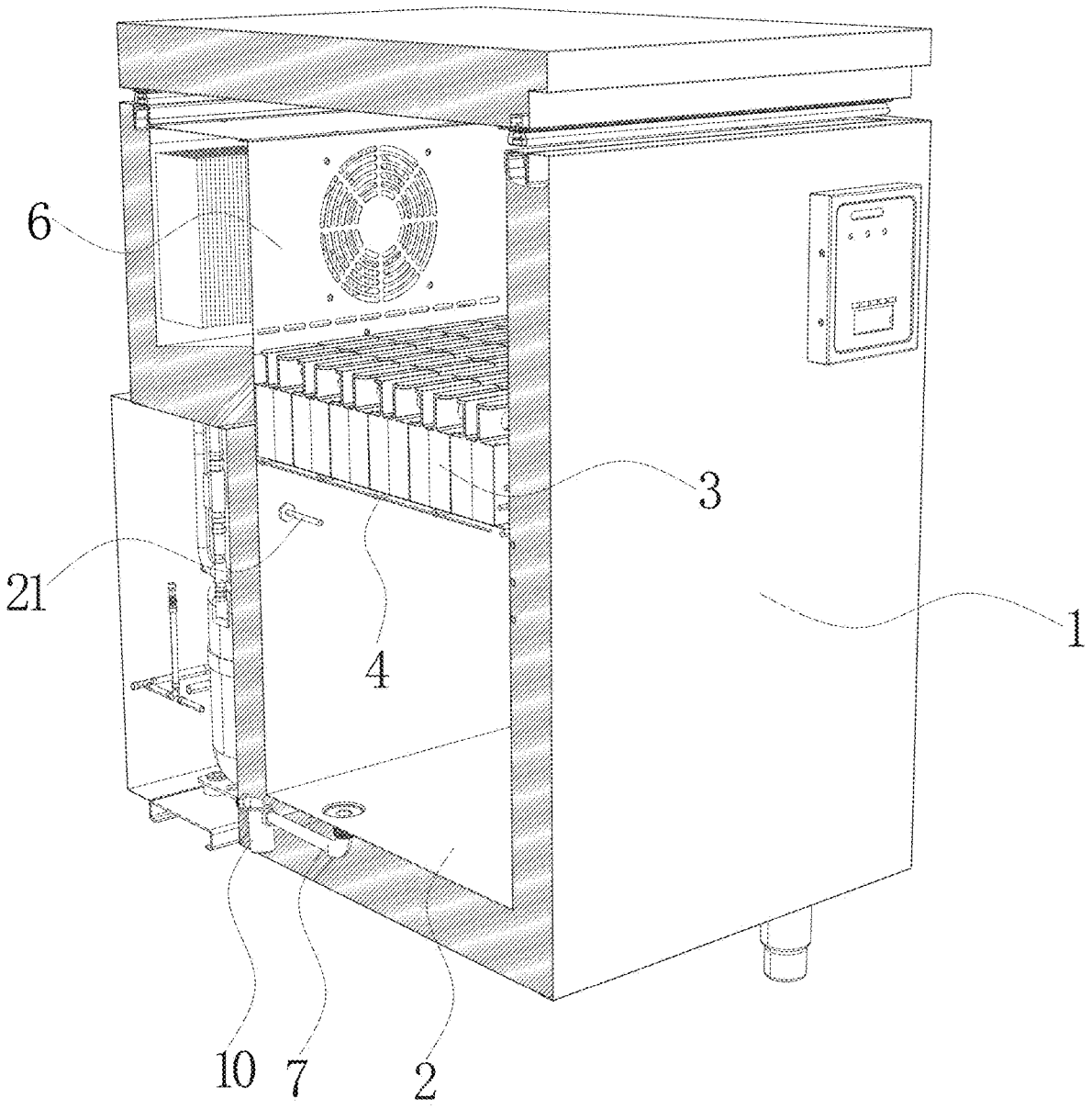
FIG. 20 is a detailed diagram of an internal structure of an ice maker with a pump according to an embodiment of the present disclosure.

Optionally, as shown in FIG. 20, the ice maker further includes a pump 10, which is connected to the refrigeration box 2 through the water inlet pipe 7. The pump 10 is configured to drive the water in the refrigeration box 2 to flow. In this embodiment, the pump 10 is provided outside the refrigeration box 2 to drive water in the refrigeration box 2 to flow before freezing. This can help discharge some dissolved gases in water before phase changes (i.e. before freezing) of the water, and also can make the temperature of the water more balanced, thereby shortening the process of ice making.

Figure 10:
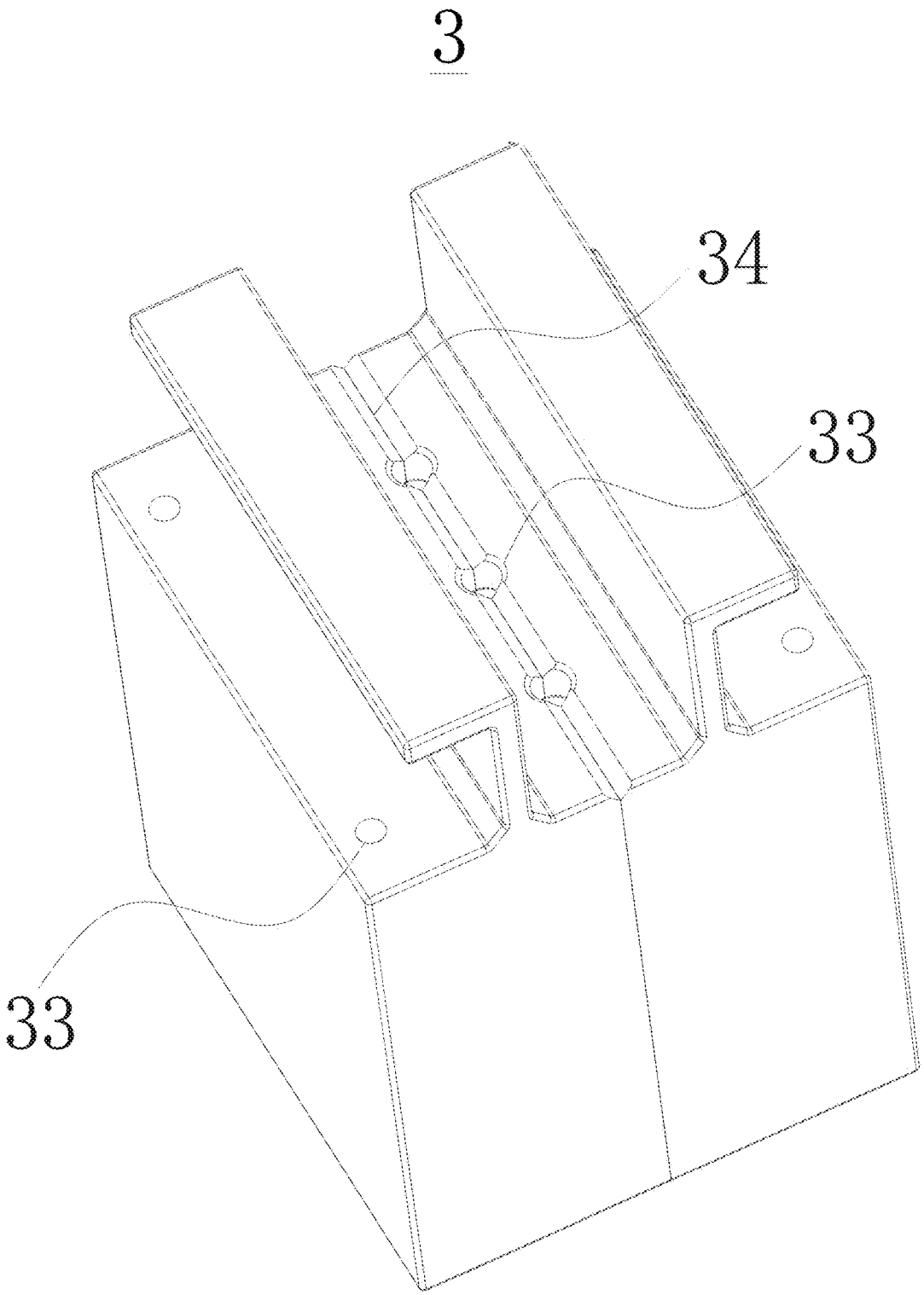
FIG. 10 is a schematic diagram of a top of an ice container according to an embodiment of the present disclosure.
Figure 11:
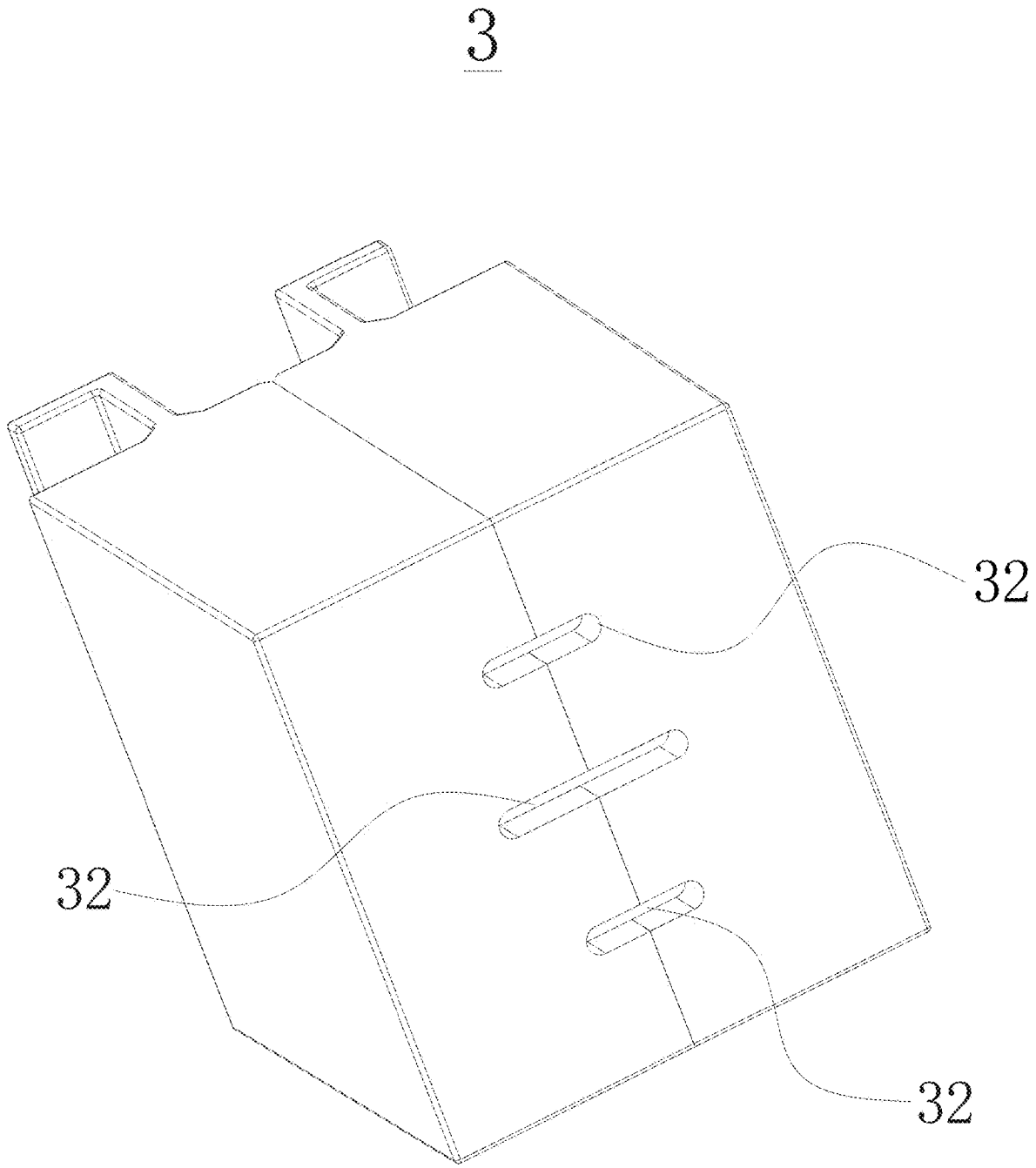
FIG. 11 is a schematic diagram of a bottom of an ice container according to an embodiment of the present disclosure.
Figure 14:
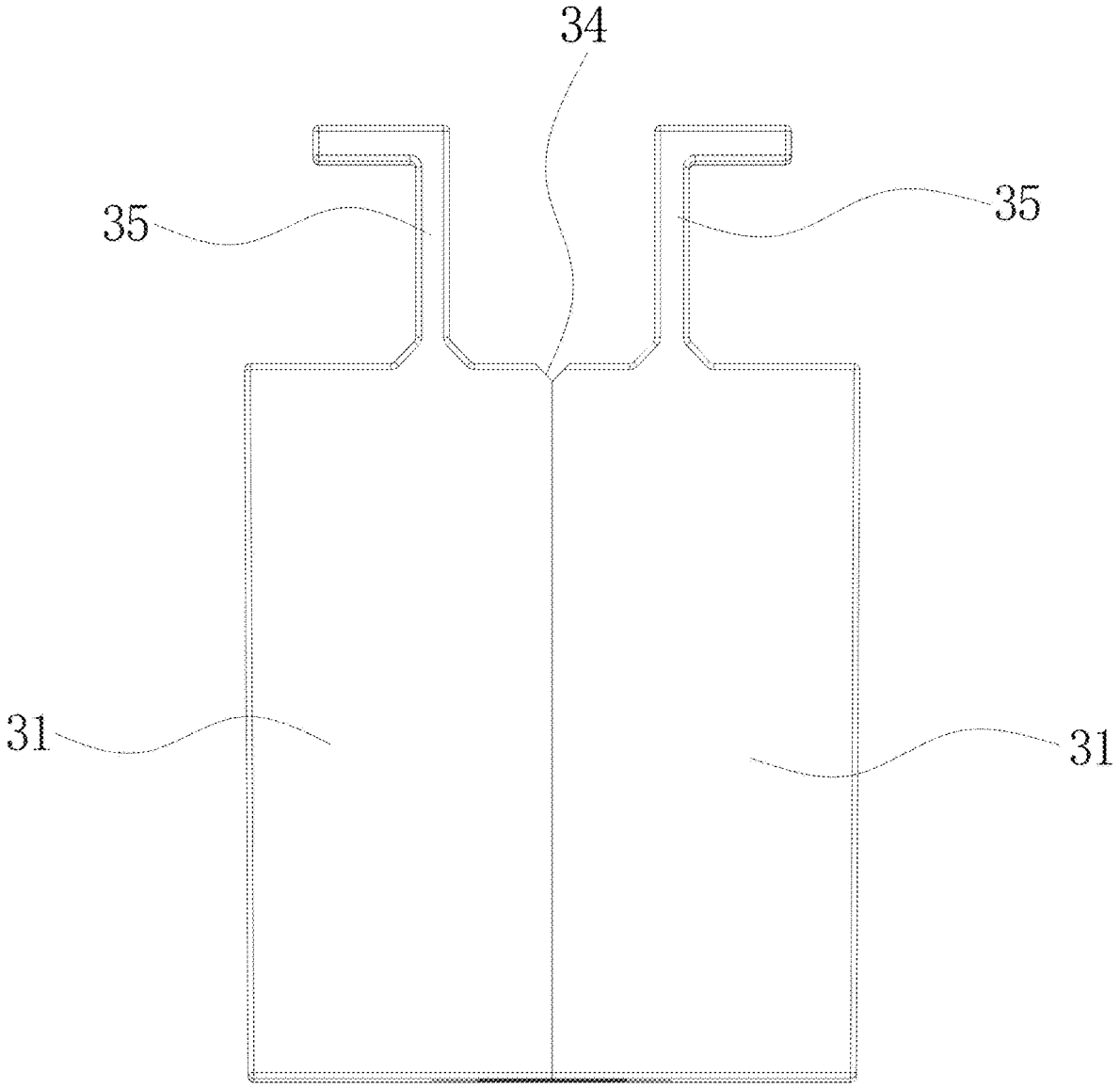
FIG. 14 is a side view of an ice container according to an embodiment of the present disclosure.

Furthermore, the water in the refrigeration box 2 enters the die cavities 31 from the water inlet holes 32 and then flows out from the water outlet holes 33 and then flows back to the refrigeration box 2. If the water flow at the tops of the ice containers 3 is not drained, the water flowing out from the water outlet holes 33 will still stay at the tops of the ice containers 3 for a long time, and this part of the water will freeze and block the water inlet holes 32 when cooling down, thereby affecting normal formation of the ice in the die cavities 31. Therefore, to avoid the above situation, as shown in FIG. 10 and FIG. 14, in some embodiments of the present disclosure, a water outlet groove 34 is further formed in a top of the ice container 3, and the water outlet groove 34 is connected to each water outlet hole 33 and extends to an edge of the ice container 3. In this way, the water flowing out of the water outlet holes 33 can be collected by the water outlet groove 34 and flow to the edge of the ice container 3 under the guidance of the water outlet groove 34 and finally flow back into the refrigeration box 2. Furthermore, as shown in FIG. 10 and FIG. 14, to improve the water outlet efficiency, in the embodiments of the present disclosure, the cross section of the water outlet groove 34 is arranged in a V shape. Of course, while ensuring the water collection effect of the water outlet groove 34, the cross section of the water outlet groove 34 can also be designed in a plurality of other shapes, such as a rectangular shape. Moreover, to improve the heat exchange effect, the water outlet holes 33 that are not communicated with the water outlet groove 34 are also added to the tops of some ice containers 3.

Optionally, the ice container 3 of the present disclosure can be made separately by an injection molding process, or can be formed by combining a plurality of assembly members 301. In fact, the structural design of a plurality of assembly members 301 is easier to shape and convenient to use. Specifically, as shown in FIG. 10 to FIG. 14, in the embodiments of the present disclosure, the ice container 3 is formed by combining two assembly members 301, the two assembly members 301 are respectively a first assembly member 301*a* and a second assembly member 301*b*, a first water inlet assembly groove 3021 and a first water outlet assembly groove 3022 are formed in tops of opposite side surfaces of the first assembly member 301*a* and the second assembly member 301*b*, a second water inlet assembly groove 3023 and a second water outlet assembly groove 3024 are formed in bottoms of the opposite side surfaces of the first assembly member 301*a* and the second assembly member 301*b*, a first special-shaped groove 3031 is formed in the first assembly member 301*a*, a second special-shaped groove 3032 is formed in the second assembly member 301*b*, the first special-shaped groove 3031 and the second special-shaped groove 3032 are butted with each other to form the die cavity 31, the first water inlet assembly groove 3023 and the second water inlet assembly groove 3024 are butted with each other to form the water inlet hole 32, and the first water outlet assembly groove 3021 and the second water outlet assembly groove 3022 are butted with each other to form the water outlet hole 33. The ice container 3 formed by combining the assembly members 301 can better adjust the shape of the die cavity 31 and the positions of the water inlet hole 32 and the water outlet hole 33. In fact, to improve the infiltration effect of the cold air and improve the ice making efficiency, more water outlet holes 33 that are not formed by combining the assembly members 301 can also be provided at the top of the ice container 3, and the water inlet hole 32 that is not formed by combining the assembly members 301 is also provided at the bottom of the ice container 3.

Figure 12:
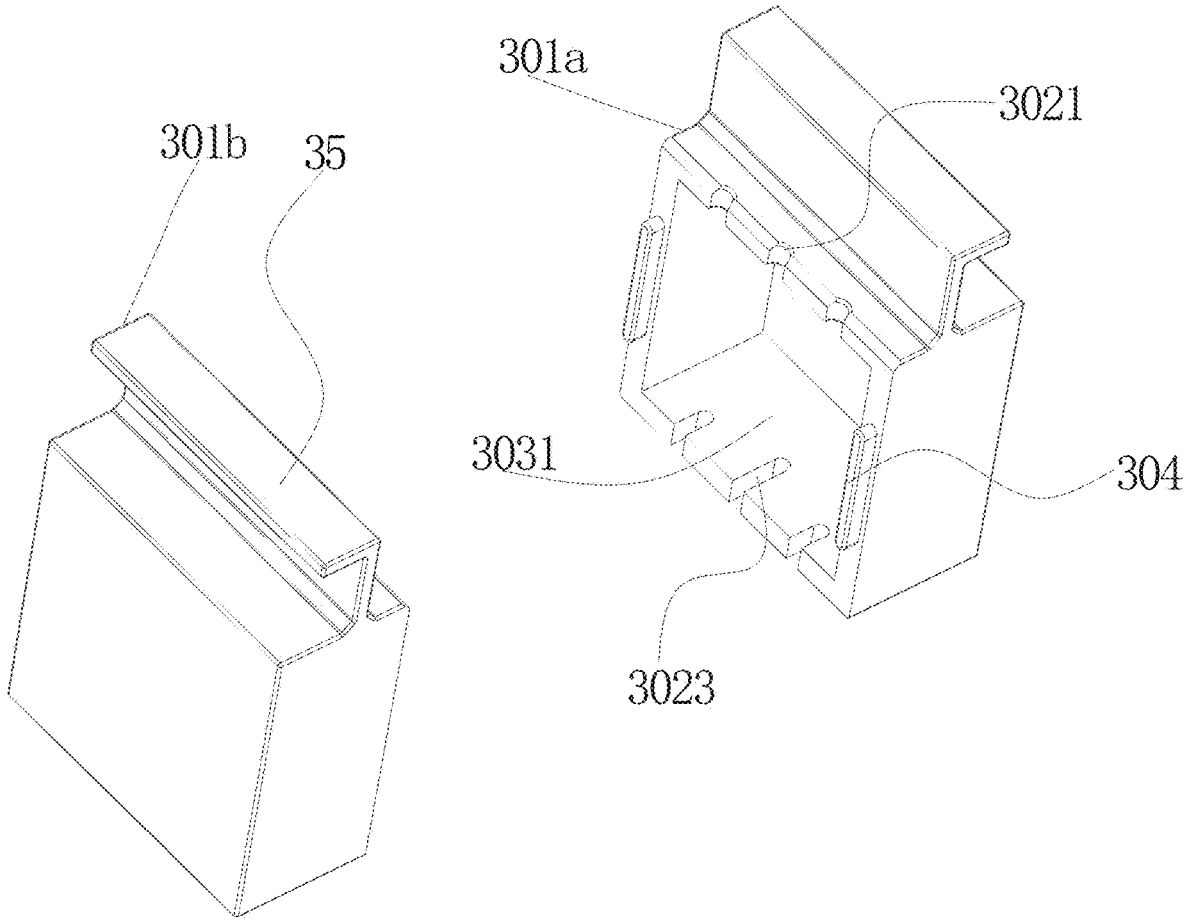
FIG. 12 is a schematic structural diagram 1 of an assembly member according to an embodiment of the present disclosure.
Figure 13:
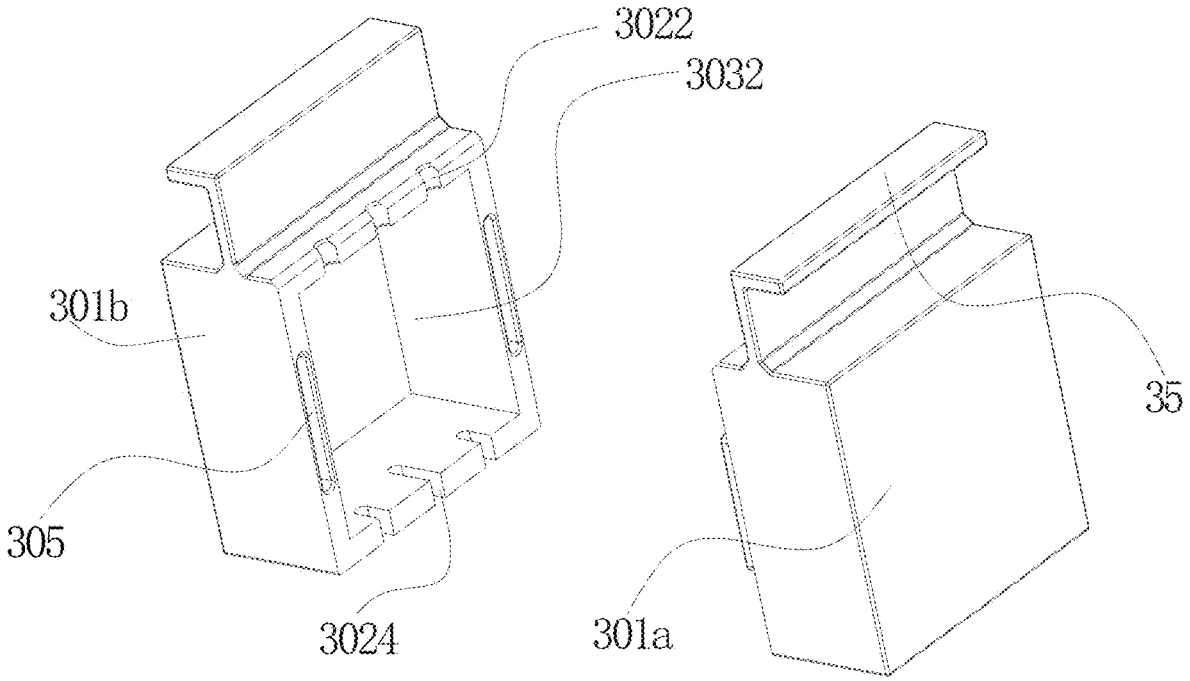
FIG. 13 is a schematic structural diagram 2 of an assembly member according to an embodiment of the present disclosure.

Furthermore, as shown in FIG. 12 and FIG. 13, for the assembly members 301 of the present disclosure, to ensure effective connection between two assembly members 301, an assembly protrusion 304 is provided on a side surface of the first assembly member 301*a*, and an assembly groove 305 matching the assembly protrusion 304 is formed in the second assembly member 301*b*. In actual use, the assembly protrusion 304 is snap-fitted into the assembly groove 305. That is, the first assembly member 301*a* and the second assembly member 301*b* are clamped and connected through the assembly protrusion 304 and the assembly groove 305. Of course, while ensuring the connection effect of the assembly members 301, the assembly members 301 can also be provided with other connection structures to implement combined connection between the plurality of assembly members 301.

Furthermore, as shown in FIG. 12 and FIG. 13, in some embodiments of the present disclosure, a grabbing portion 35 is provided at a top of the ice container 3 or the assembly member 301. The operator can grab the assembly member 301 by holding the grabbing portion 35 to complete mounting and removal of the assembly member 301, thereby achieving skillful structural design and good use experience. When the ice container 3 is not formed by combining the assembly members 301, the operator can also grab the ice container 3 by directly holding the grabbing portion 35.

Figure 9:
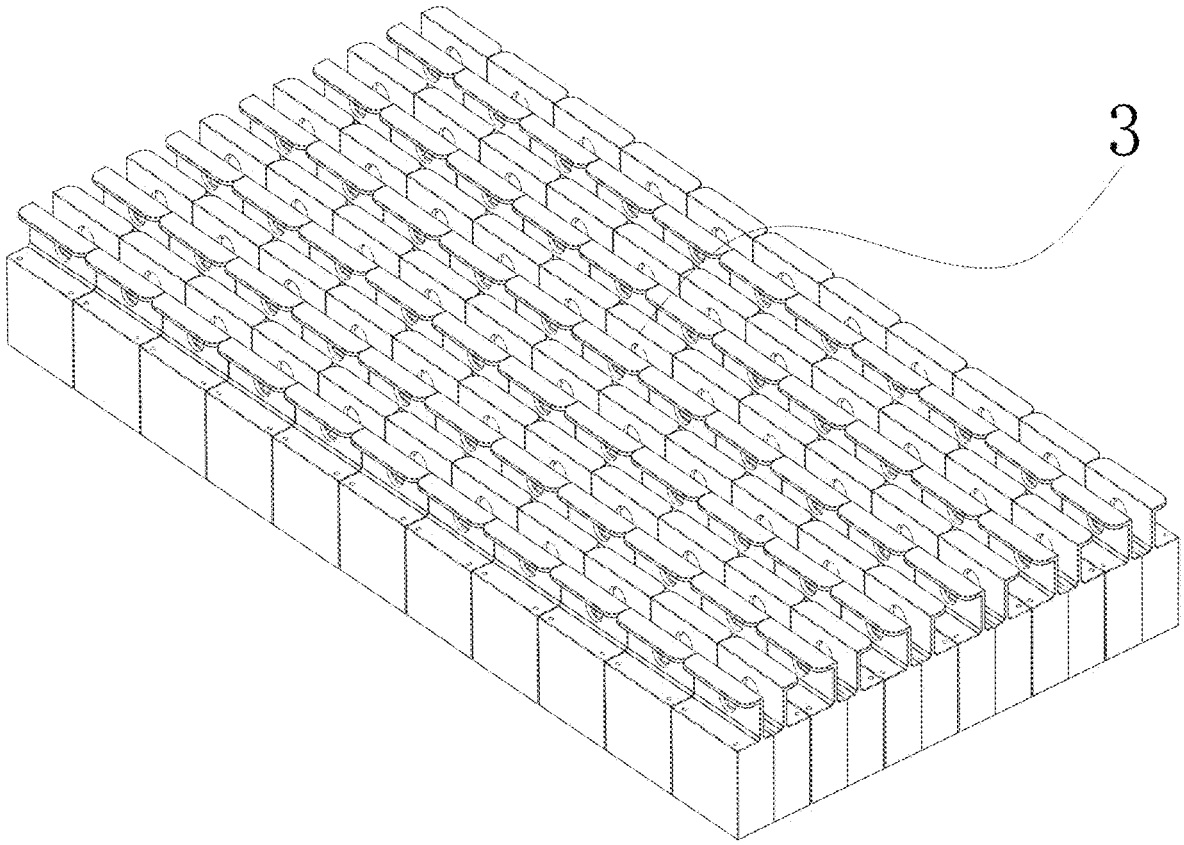
FIG. 9 is a schematic diagram of assembly of an ice container according to an embodiment of the present disclosure.
Figure 15:
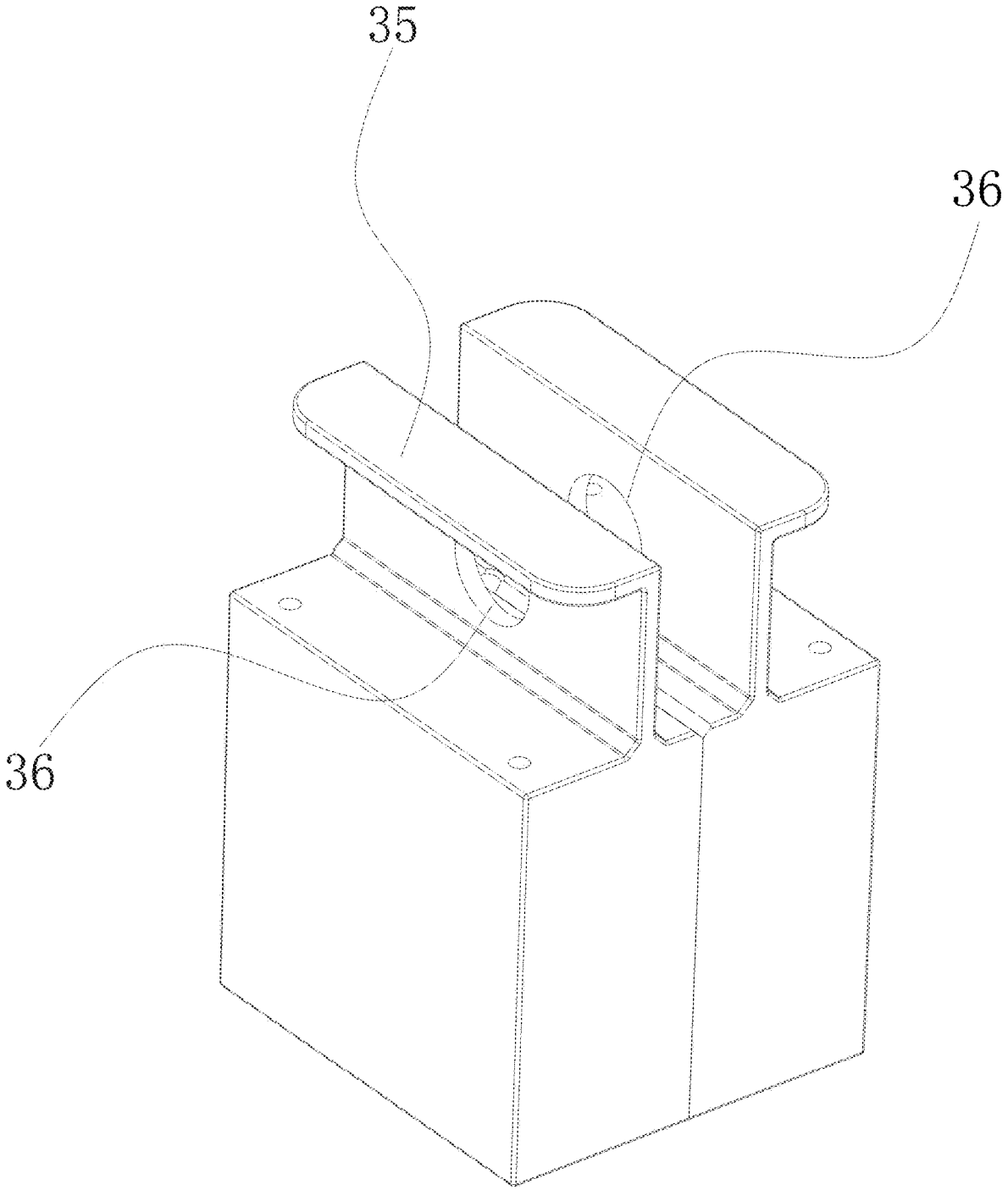
FIG. 15 is a schematic structural diagram of an ice container according to another embodiment of the present disclosure.

Optionally, as shown in FIG. 9 and FIG. 15, in some embodiments of the present disclosure, a hollow hole 36 is formed in the grabbing portion 35 of the ice container 3. This design can reduce self-weight of the ice container 3, and is convenient for the operator to operate the ice container 3.

In addition, to facilitate the formation of the ice, in some embodiments of the present disclosure, the ice container 3 is made of a soft material or an elastic material. Specifically, the ice container 3 in the embodiments of the present disclosure is preferably made of silica gel. The raw material of silica gel is common and easy to shape, the die cavities 31 of different shapes can be produced according to the needs of use, and the use experience is good. Of course, the material of the ice container 3 is not limited to the silica gel, and the production staff can also choose other materials that are easy to shape to complete the production of the ice container 3.

Figure 4:
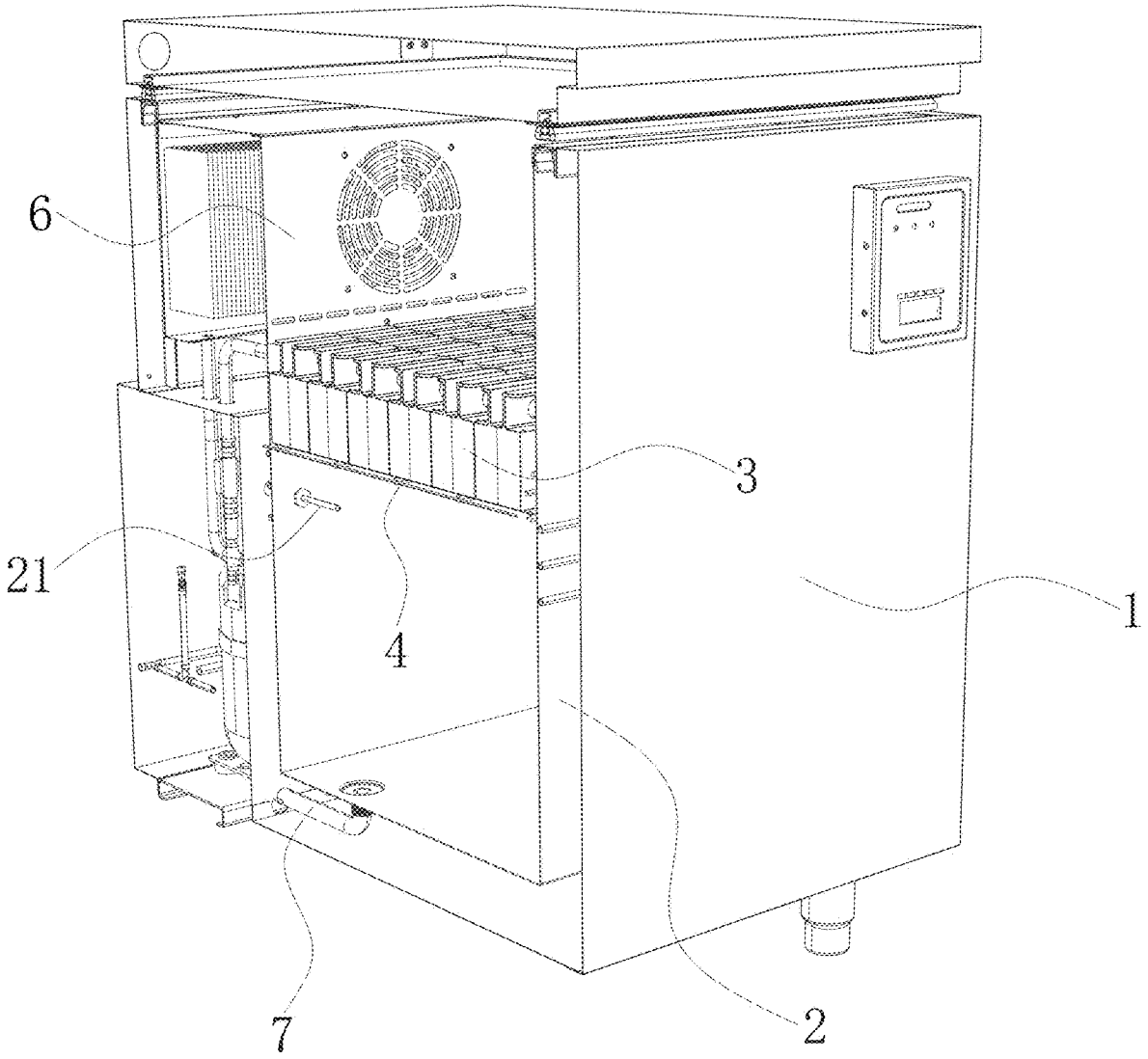
FIG. 4 is a side sectional view of an internal structure of an ice maker in which a thermal insulation layer is not provided according to an embodiment of the present disclosure.
Figure 5:
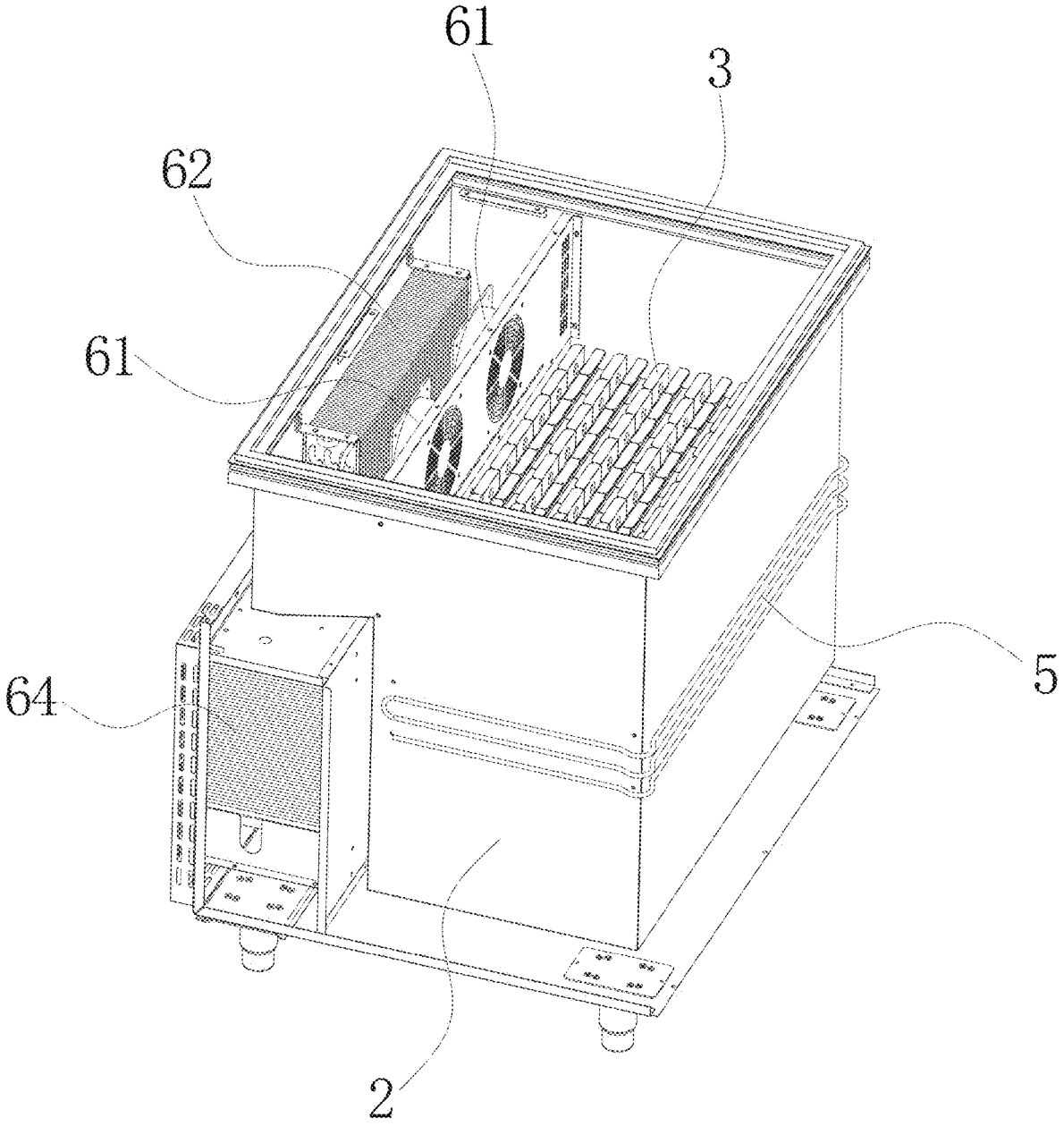
FIG. 5 is a schematic diagram of an internal structure of an ice maker according to an embodiment of the present disclosure.
Figure 6:
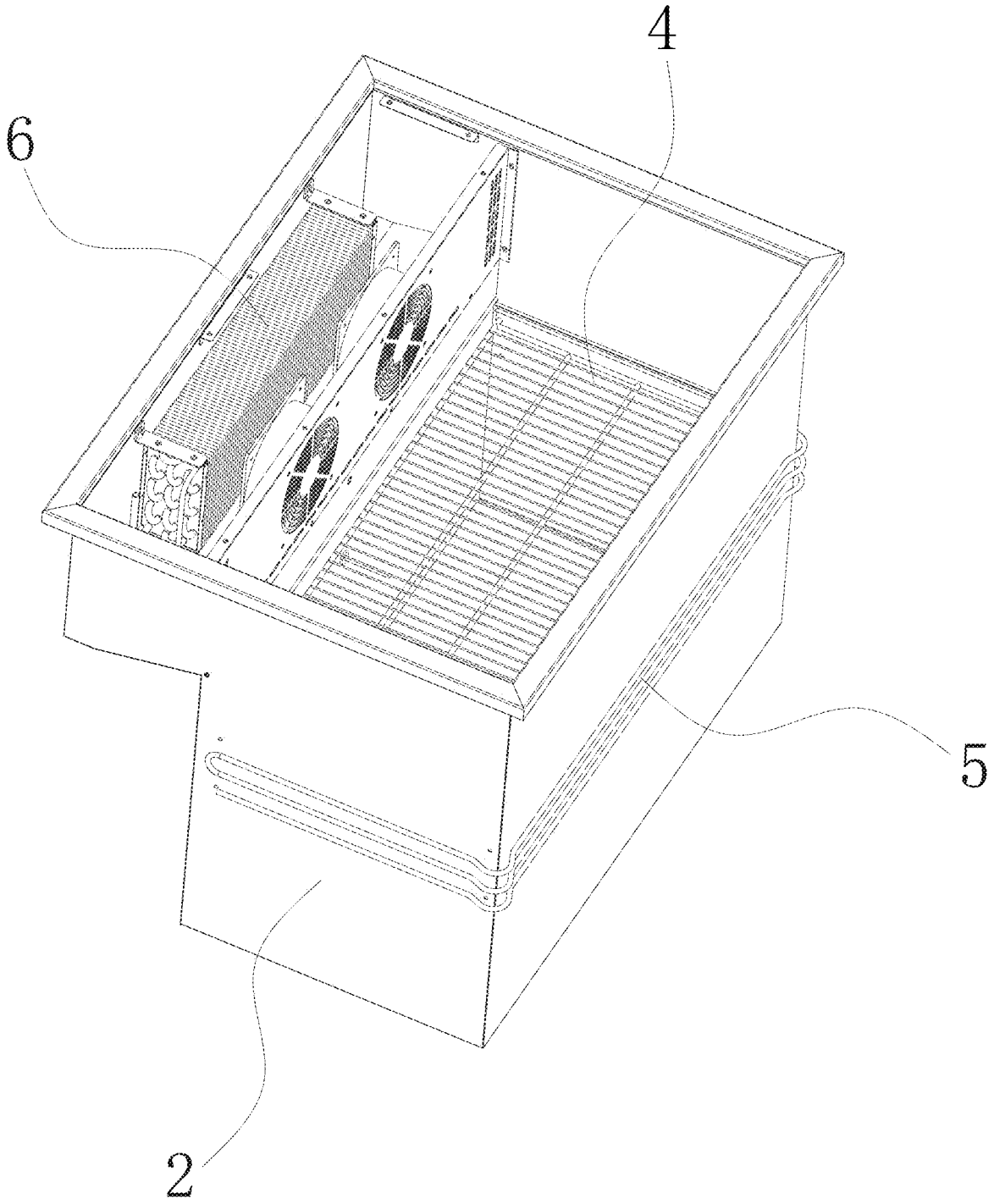
FIG. 6 is a schematic structural diagram of a refrigeration box in which no ice container is provided according to an embodiment of the present disclosure.
Figure 7:
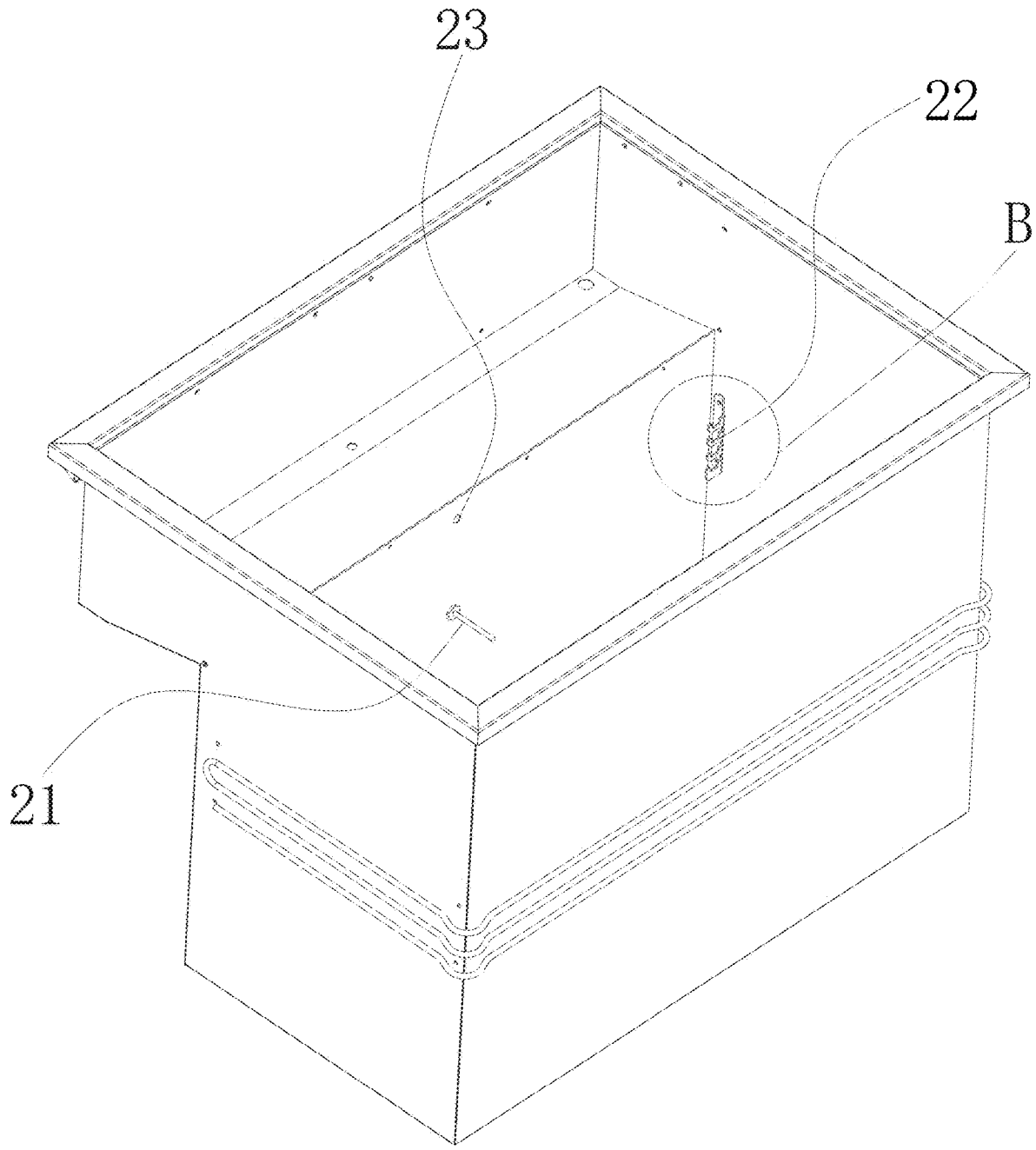
FIG. 7 is a detailed view of an internal structure of a refrigeration box according to an embodiment of the present disclosure.

Optionally, as shown in FIG. 4 and FIG. 7, in some embodiments of the present disclosure, a temperature sensor 21 is provided in the refrigeration box 2. The operator can obtain the temperature of the water body in the refrigeration box 2 in time through the temperature sensor 21 to complete the monitoring of the temperature in the refrigeration box 2, thereby ensuring normal ice making process.

As shown in FIG. 4 to FIG. 7, since both the fan 61 and the evaporator 62 are located in the refrigeration box 2, the water level in the refrigeration box 2 needs to be limited, otherwise the excessively high water level will submerge the fan 61 and the evaporator 62 and affect the normal use of the ice maker. Therefore, in some embodiments of the present disclosure, a water overflow hole 23 is formed in a side surface of the refrigeration box 2, and is connected to the water inlet pipe 7 through a water outlet pipe. After the water level in the refrigeration box 2 reaches the position of the water overflow hole 23, the excess water can get back in the water inlet pipe 7 via the water outlet pipe through the water overflow hole 23, to ensure the dynamic balance of the water flow in a water tank. Moreover, it can be seen from the figures that the refrigeration box 2 extends laterally beside the water overflow hole 23 to form a mounting position to arrange the fan 61 and the evaporator 62.

Figure 8:
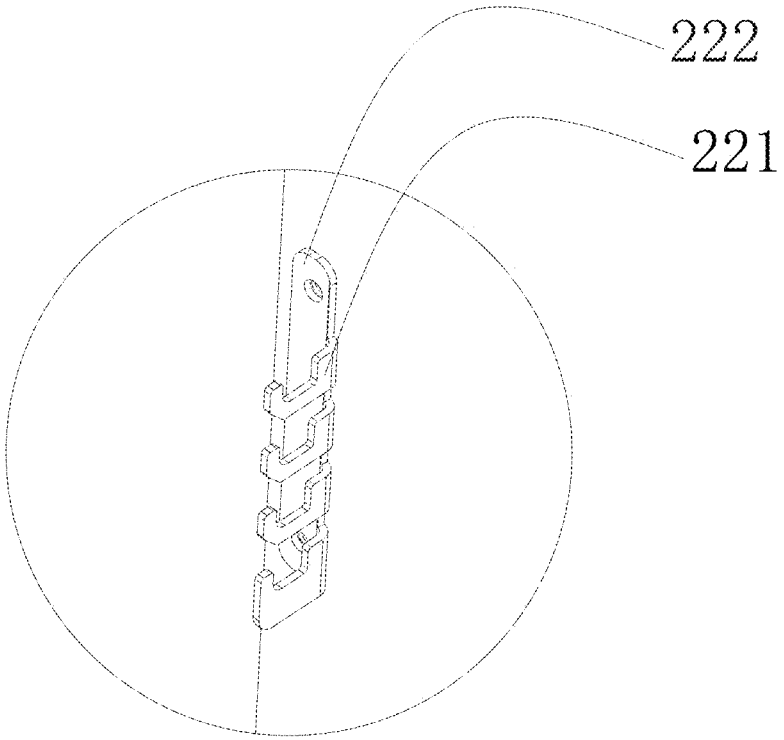
FIG. 8 is a detailed view of a place B in FIG. 7.

While ensuring normal use of the grid tray 4, the support member 22 of the present disclosure also has a plurality of structural forms. Specifically, as shown in FIG. 7 and FIG. 8, in the embodiments of the present disclosure, the support member 22 includes a plurality of hooks 221 sequentially arranged along a vertical direction. In this way, when the volume of the ice containers 3 on the grid tray 4 is large, the operator can arrange the grid tray 4 on the lower hook 221 to reduce the overall height of the ice containers 3, thereby ensuring that the ice containers 3 can be submerged into the water to achieve normal preparation of the ice. In this embodiment, to facilitate the mounting of the hooks 221, the support member 22 further includes a mounting portion 222. The plurality of hooks 221 are connected to the mounting portion 222, and the mounting portion 222 is connected to an inner side surface of the refrigeration box 2. In addition, to further improve the mounting stability of the grid tray 4, a plurality of support members 22 can be provided. For example, the support members 22 can be arranged on each inner side surface of the refrigeration box 2.

Figure 16:
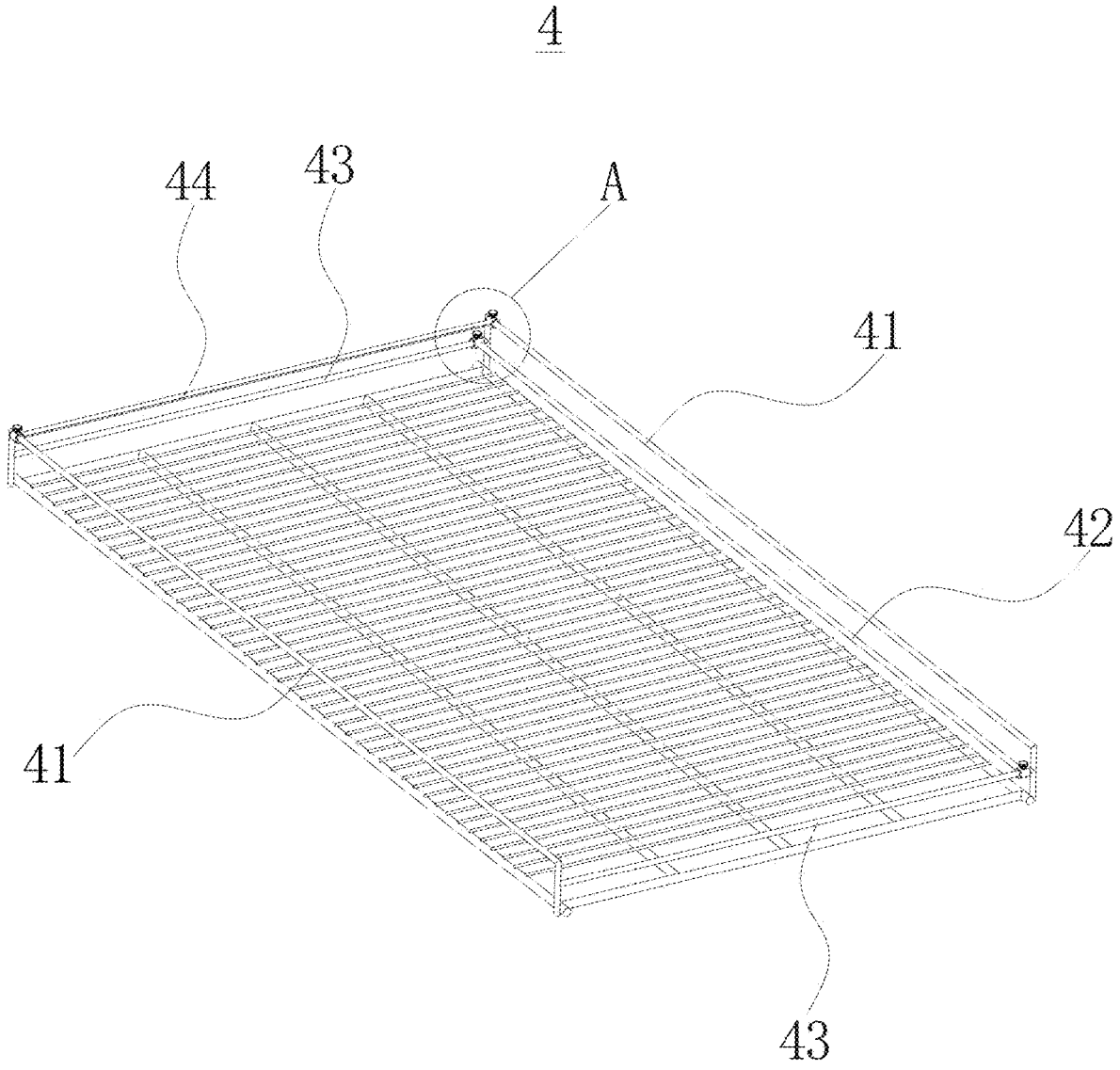
FIG. 16 is a schematic structural diagram of a grid tray according to an embodiment of the present disclosure.
Figure 17:
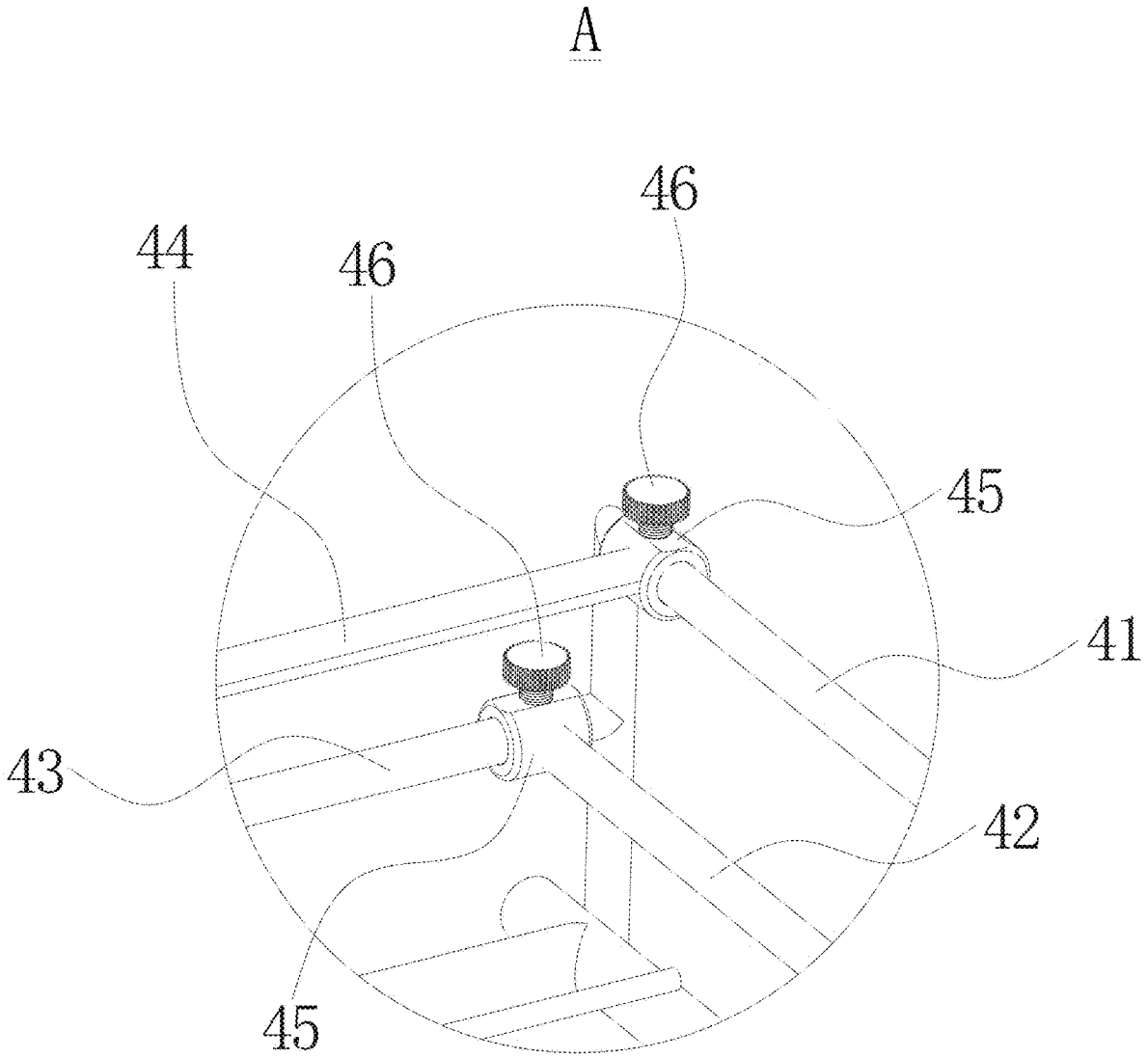
FIG. 17 is a detailed view of A shown in FIG. 16.

Optionally, as shown in FIG. 16 and FIG. 17, for the grid tray 4 of the present disclosure, in the embodiments of the present disclosure, the grid tray 4 is rectangular, first fixed rods 41 are provided on one pair of opposite side edges of the grid tray 4, a first sliding rod 42 parallel to the first fixed rods 41 is provided between the two first fixed rods 41 and can slide toward the first fixed rods 41, second fixed rods 43 are provided on the other pair of opposite side edges of the grid tray 4, and a second sliding rod 44 parallel to the second fixed rods 43 is provided between the two second fixed rods 43 and can slide toward the second fixed rods 43. Specifically, both ends of the first sliding rod 42 are respectively arranged on the second fixed rods 43 through a sleeve 45. On the basis of the arrangement of the sleeve 45, the first sliding rod 42 can slide along the second fixed rods 43. A pressing bolt 46 is provided on the sleeve 45. When the first sliding rod 42 slides to a specified position, the operator can tighten the sleeve 45 by rotating the pressing bolt 46 to stop the sliding of the first sliding rod 42. Similarly, both ends of the second sliding rod 44 are respectively arranged on the first fixed rods 41 through a sleeve 45. On the basis of the arrangement of the sleeve 45, the second sliding rod 44 can slide along the first fixed rods 41. A pressing bolt 46 is still provided on the sleeve 45. When the second sliding rod 44 slides to a specified position, the operator can tighten the sleeve 45 by rotating the pressing bolt 46 to stop the sliding of the second sliding rod 44. After the ice container 3 is disposed on the grid tray 4, the operator can limit and fix the ice container 3 by sliding the first sliding rod 42 and the second sliding rod 44, to prevent the ice container 3 from moving on the grid tray 4, thereby ensuring normal ice making process, and ensuring that the ice in the ice container 3 meet the desired effect.

Figure 18:
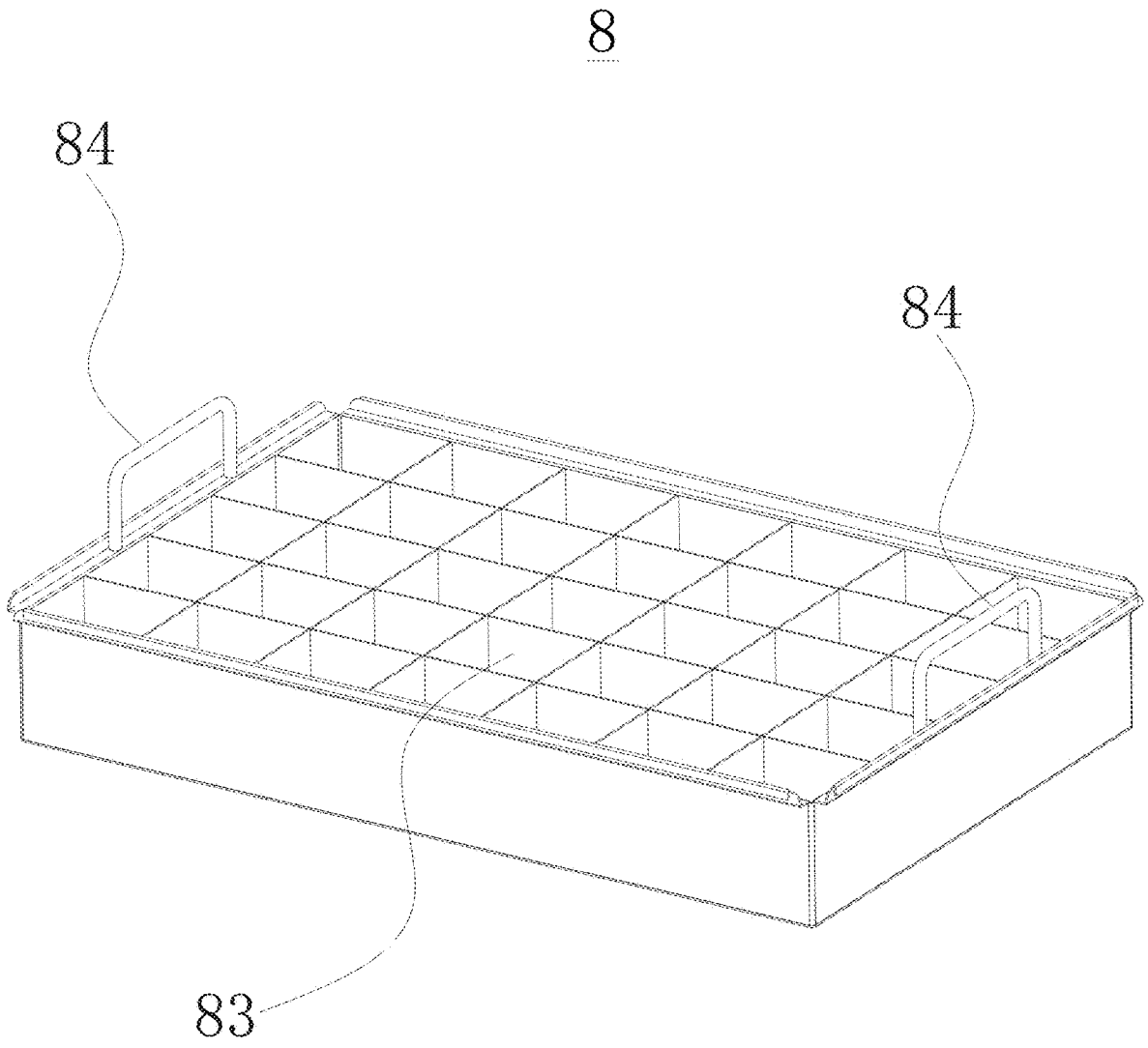
FIG. 18 is a schematic structural diagram 1 of a storage box according to an embodiment of the present disclosure.
Figure 19:
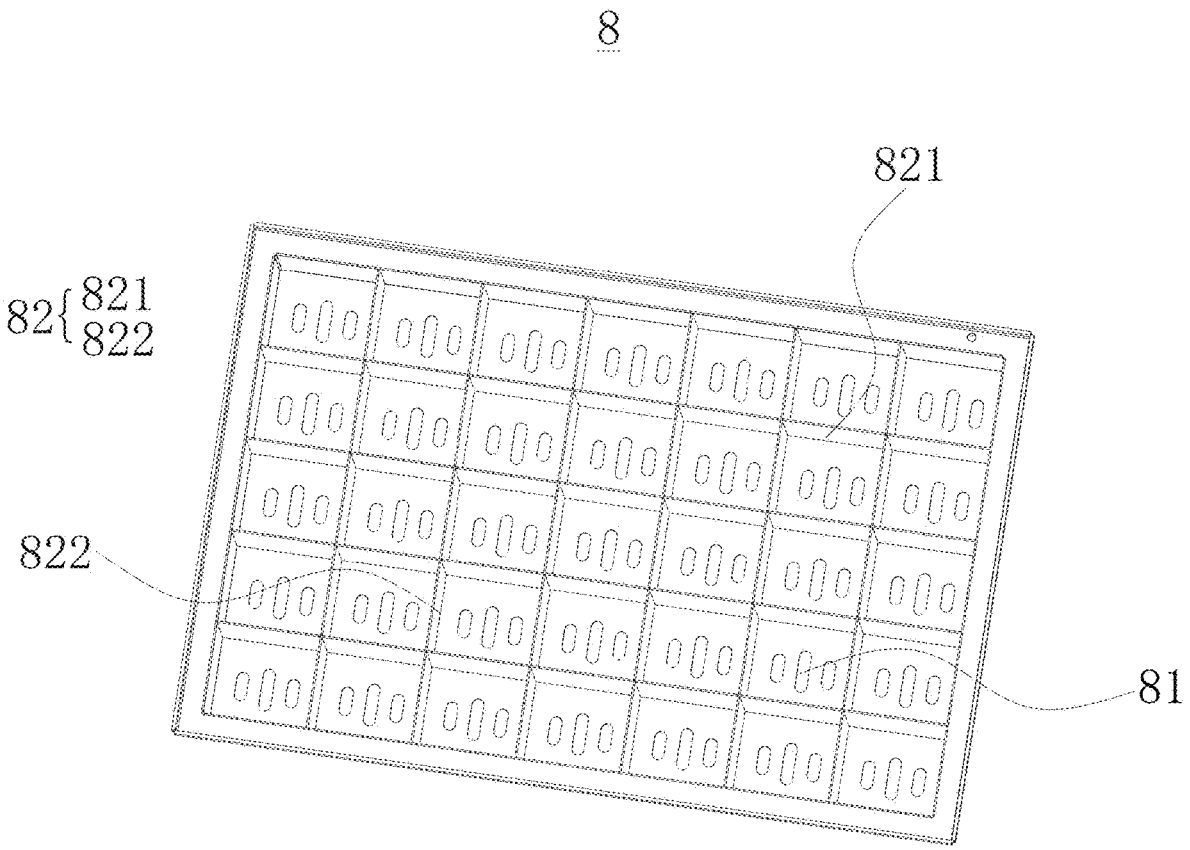
FIG. 19 is a schematic structural diagram 2 of a storage box according to an embodiment of the present disclosure.

Of course, to ensure normal storage of the ice container 3, the operator can also provide other structures to store the ice container 3 first. Specifically, as shown in FIG. 18 and FIG. 19, in some embodiments of the present disclosure, the ice maker further includes a storage box 8 configured to store the ice container 3. To ensure normal passing of the water flow, water passing holes 81 are formed in the bottoms of storage box 8. Furthermore, a plurality of storage plates 82 are provided in the storage box 8, and divide a space in the storage box 8 into a plurality of storage tanks 83 having the same or different sizes. The ice containers 3 can be directly assembled in the storage tanks 83. Based on the above structure, the operator can distinguish the ice containers 3 of different sizes through the storage tanks 83, and meanwhile, can reasonably adjust the number of the ice containers 3 placed in the storage tanks 83 according to the needs of use. The placed ice containers 3 are limited by the storage plates 82 and will not slide in the storage box 8, and therefore, the storage effect is excellent.

Furthermore, the storage plates 82 have a plurality of design forms. As shown in FIG. 18 and FIG. 19, in some embodiments of the present disclosure, the storage plates 82 include transverse plates 821 and longitudinal plates 822 perpendicular to each other. The transverse plates 821 and the longitudinal plates 822 are intersected to divide the storage box 8 into a plurality of storage tanks 83. In some other embodiments of the present disclosure, the storage plates 82 only include a plurality of parallel plates, and at this time, the storage tanks 83 are arranged in a plurality of parallel strips.

It can be found that, similar to the grabbing portion 35 of the ice container 3, a handle 84 is also provided on an edge of the storage box 8, and the operator can grab the storage box 8 by holding the handle 84 to complete mounting and removal of the storage box 8. Therefore, the ice maker has a skillful structure and good user experience.

In addition, the heating pipe 5 of the present disclosure can also be connected to the condenser 64, and heat released when the condenser 64 processes a refrigerant is employed to heat the refrigeration box 2 to complete the melting of the ice inside and outside the ice container 3.

In conclusion, the present disclosure provides an ice maker. The ice maker includes a cabinet body, and a refrigeration box and a refrigeration assembly provided in the cabinet body. The refrigeration box is connected to a water inlet pipe, a support member is provided in the refrigeration box, a grid tray is arranged on the support member, and a plurality of ice containers are sequentially arranged on the grid tray. Die cavities are provided in the ice containers, water inlet holes communicated with the die cavities are formed in bottoms of the ice containers, and water outlet holes communicated with the die cavities are formed in tops of the ice containers. The refrigeration assembly includes a fan, an evaporator, a compressor, and a condenser. The fan and the evaporator are disposed in the refrigeration box and located above the ice containers, and the compressor and the condenser are disposed outside the refrigeration box and connected to the evaporator. A heating pipe wraps the refrigeration box. A thermal insulation layer wrapping the refrigeration box and the heating pipe is provided in the cabinet body and a cabinet door. A pump configured to drive water in the refrigeration box to flow is provided outside the refrigeration box, and the pump is connected to the refrigeration box through a pipe. Compared with the prior art, the ice maker has an ingenious structural design, achieves high transparency of prepared ice and has low cost of ice making with short time.

The foregoing are merely descriptions of the preferred embodiments of the present disclosure. It should be noted that several improvements and replacements, which can realize that the phase change process of water from liquid to solid exhibits a single directionality, can be made by a person of ordinary skill in the art without departing from the technical principle of the present disclosure, and these improvements and replacements shall also be deemed as falling within the protection scope of the present disclosure.

The invention claimed is:

1. An ice maker, comprising:

a cabinet body connected to a cabinet door configured to open or close the cabinet body;

a refrigeration box provided in the cabinet body, wherein a bottom surface or a side surface of the refrigeration box is connected to a water inlet pipe, a support member is provided on an inner side surface of the refrigeration box, a grid tray is arranged on the support member, and a plurality of ice containers are provided on the grid tray, die cavities are provided in the ice containers, water inlet holes communicated with the die cavities are formed in bottoms of the ice containers, and water outlet holes communicated with the die cavities are formed in tops of the ice containers;

a refrigeration assembly comprising a fan, an evaporator, a compressor, and a condenser, wherein the fan and the evaporator are disposed in the refrigeration box and located above the ice containers, and the compressor and the condenser are disposed outside the refrigeration box and connected to the evaporator;

a heating pipe provided in the cabinet body and wrapping the refrigeration box; and a thermal insulation layer provided in the cabinet body and the cabinet door and wrapping the refrigeration box and the heating pipe;

wherein the ice container is formed by combining a separate first assembly member and a separate second assembly member; the first assembly member and the second assembly member are butted with each other to form a water outlet groove, and the water outlet groove is communicated with the water outlet holes and extends to an edge of the ice container.

2. The ice maker according to claim 1, wherein the refrigeration assembly is configured to cool water in the die cavities and the refrigeration box in a single direction.

3. The ice maker according to claim 1, wherein the ice maker further comprises a pump, the pump is connected to the refrigeration box through the water inlet pipe, and the pump is configured to drive the water in the refrigeration box to flow.

4. The ice maker according to claim 1, wherein a first water inlet assembly groove and a first water outlet assembly groove are formed in a side surface of the first assembly member opposite to the second assembly member, a second water inlet assembly groove and a second water outlet assembly groove are formed in a side surface of the second assembly member opposite to the first assembly member, a first special-shaped groove is formed in the first assembly member, a second special-shaped groove is formed in the second assembly member, the first special-shaped groove and the second special-shaped groove are butted with each other to form the die cavity, the first water inlet assembly groove and the second water inlet assembly groove are butted with each other to form the water inlet hole, and the first water outlet assembly groove and the second water outlet assembly groove are butted with each other to form the water outlet hole.

5. The ice maker according to claim 1, wherein the ice container is made of an elastic soft material.

6. The ice maker according to claim 1, wherein a temperature sensor is provided in the refrigeration box.

7. The ice maker according to claim 1, wherein a water overflow hole is formed in a side surface of the refrigeration box, and is connected to the water inlet pipe through a water outlet pipe.

8. The ice maker according to claim 1, wherein the support member comprises a plurality of hooks sequentially arranged along a vertical direction.

9. The ice maker according to claim 1, wherein the grid tray is rectangular, a first fixed rod and a second sliding rod are provided on one pair of opposite side edges of the grid tray, a second fixed rod and a first sliding rod are provided on the other another pair of opposite side edges of the grid tray, the first sliding rod is capable of sliding toward the first fixed rod, and the second sliding rod is capable of sliding toward the second fixed rod.

10. The ice maker according to claim 4, wherein the first assembly member and the second assembly member are clamped and connected to each other, an assembly protrusion is provided on the side surface of the first assembly member facing the second assembly member, and an assembly groove matching the assembly protrusion is formed in the second assembly member.

11. The ice maker according to claim 10, wherein grabbing portions are provided at a top of the first assembly member and a top of the second assembly member.

* * * * *